US008965250B2

(12) United States Patent
Komatsu et al.

(10) Patent No.: US 8,965,250 B2
(45) Date of Patent: Feb. 24, 2015

(54) CAP, POWDER CONTAINER, DEVELOPER SUPPLY DEVICE, AND IMAGE FORMING APPARATUS

(75) Inventors: Makoto Komatsu, Kanagawa (JP); Tsukuru Kai, Kanagawa (JP); Tadashi Hayakawa, Kanagawa (JP); Hiroshi Hosokawa, Kanagawa (JP); Daichi Yamaguchi, Kanagawa (JP); Junichi Matsumoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 164 days.

(21) Appl. No.: 13/318,503

(22) PCT Filed: Feb. 1, 2011

(86) PCT No.: PCT/JP2011/052462

§ 371 (c)(1),
(2), (4) Date: Nov. 2, 2011

(87) PCT Pub. No.: WO2011/114798

PCT Pub. Date: Sep. 22, 2011

(65) Prior Publication Data

US 2012/0045244 A1 Feb. 23, 2012

(30) Foreign Application Priority Data

Mar. 17, 2010 (JP) ..... 2010-061671
Mar. 17, 2010 (JP) ..... 2010-061682

(51) Int. Cl.
*G03G 15/08* (2006.01)

(52) U.S. Cl.
CPC ..... *G03G 15/0886* (2013.01); *G03G 15/0839* (2013.01); *G03G 15/0872* (2013.01);
(Continued)

(58) Field of Classification Search
CPC ..... G03G 15/0834; G03G 15/0839; G03G 15/0868; G03G 15/0872; G03G 15/0886; G03G 2215/0668; G03G 2215/069
USPC ..... 399/260, 262; 222/DIG. 1
See application file for complete search history.

(56) References Cited

U.S. PATENT DOCUMENTS 5,557,382 A * 9/1996 Tatsumi et al. ..... 399/262
5,722,014 A * 2/1998 Fike ..... 399/119

(Continued)

FOREIGN PATENT DOCUMENTS

JP 06149049 A * 5/1994 ..... G03G 15/08
JP 08 152783 6/1996

(Continued)

OTHER PUBLICATIONS

International Search Report Issued Mar. 1, 2011 in PCT/JP11/052462 Filed Feb. 1, 2011.

*Primary Examiner* — Benjamin Schmitt
(74) *Attorney, Agent, or Firm* — Oblon, Spivak, McClelland, Maier & Neustadt, L.L.P.

(57) ABSTRACT

A cap is configured to be attached to a developer container that discharges developer contained in the container body out of the container body through a discharge port defined in a portion of the container body. The cap includes a first attaching member and a second attaching member that are detachably assembled into one piece. When the first attaching member or the second attaching member receives a rotary force, the first attaching member and the second attaching member are separated from each other, and only the first attaching member is released from the container body.

27 Claims, 30 Drawing Sheets

(52) U.S. Cl.
CPC ..... *G03G15/0837* (2013.01); *G03G 15/0834* (2013.01); *G03G 2215/0668* (2013.01); *G03G 2215/069* (2013.01); *Y10S 222/01* (2013.01)
USPC ..... 399/260; 399/262; 222/DIG. 1

(56) References Cited

U.S. PATENT DOCUMENTS

| | | | | |
|---|---|---|---|---|
| 7,277,664 | B2 | 10/2007 | Katsuyama et al. | |
| 7,542,703 | B2 | 6/2009 | Kasahara et al. | |
| 7,822,371 | B2 | 10/2010 | Taguchi et al. | |
| 2004/0126144 | A1 | 7/2004 | Yoshino et al. | |
| 2007/0122205 | A1* | 5/2007 | Taguchi et al. | 399/258 |
| 2008/0298820 | A1 | 12/2008 | Sugiura | |

FOREIGN PATENT DOCUMENTS

| | | |
|---|---|---|
| JP | 09 006115 | 1/1997 |
| JP | 2004 196322 | 7/2004 |
| JP | 2007 178969 | 7/2007 |
| JP | 2008 292596 | 12/2008 |

* cited by examiner

CAP, POWDER CONTAINER, DEVELOPER SUPPLY DEVICE, AND IMAGE FORMING APPARATUS

TECHNICAL FIELD

The present invention is directed generally to a cap for a powder container that contains developer, a powder container including the cap, and an image forming apparatus having the function of at least one of a copier, a printer, and a facsimile machine.

BACKGROUND ART

There have been known powder containers of a type that rotates a container body containing developer therein to thereby release toner through a discharge port. Some group of such rotating-type powder containers includes, on or near the bottom of the container, a protrusion that is brought into engagement with a distal end of a rotary shaft to transmit a driving force to the container body and rotate the container body. Other group of the rotating-type powder containers includes, in a portion of the powder container, a drive transmission member that rotates the container body when receiving a driving force. An example of the former is disclosed in Japanese Patent Application Laid-open No. H09-6115, while an example of the latter is disclosed in Japanese Patent Application Laid-open No. 2007-178969.

Some group of the conventional rotating-type powder containers is configured as follows: at shipment from a factory, the powder container is placed in a closed state where the discharge port is covered with a shutter provided on a cover member rotatable relative to the container body; the shutter is opened when the powder container is loaded on an apparatus and the container body is rotated. Other group is configured as follows: the discharge port is placed in a closed state with a cap; when the power container is loaded on an apparatus, the cap is removed to open the discharge port. At factory shipment, each of these two groups of powder containers is sealed with the cap, which is to be removed when the powder container is to be used. The cap is desirably efficiently attached to the container during assembly.

It is therefore an object of the present invention to provide a cap, for a powder container, exhibiting favorable operability to open and close a discharge port of the powder container, a powder container including the cap, and an image forming apparatus including the cap.

DISCLOSURE OF INVENTION

According to an aspect of the present invention, there is provided a cap configured to be attached to a developer container that discharges developer contained in the container body out of the container body through a discharge port defined in a portion of the container body. The cap includes a first attaching member and a second attaching member. The first attaching member and the second attaching member are detachably assembled into one piece. When any one of the first attaching member and the second attaching member receives a rotary force, the first attaching member and the second attaching member are separated from each other, and only the first attaching member is released from the container body.

According to the aspect of the present invention, the cap is configured to be attached to a developer container that discharges developer contained in the container body out of the container through a discharge port defined in a portion of the container body. When any one of the first attaching member and the second attaching member, which are detachably assembled into one piece, receives a rotary force, the first attaching member and the second attaching member are separated from each other, and only the first attaching member is released from the container body. Thus, operability in attachment and removal of the cap to and from the developer container is improved.

BRIEF DESCRIPTION OF DRAWINGS

FIG. 33A illustrates a not-mounted-yet state; FIG. 33B is a schematic enlarged cross-sectional view of a claw in an engaged state.

FIG. 44A is a perspective view of the fixing member being oval in outer shape; FIG. 44B is a perspective view of the fixing member having a knurled outer peripheral surface; FIG. 44C is a perspective view of the fixing member having recesses in its outer peripheral surface; FIG. 44D is a perspective view of the fixing member having a groove in an outer peripheral surface; FIG. 44E is a perspective view of the fixing member having a protrusion its outer peripheral surface.

BEST MODE(S) FOR CARRYING OUT THE INVENTION

Figure 1:
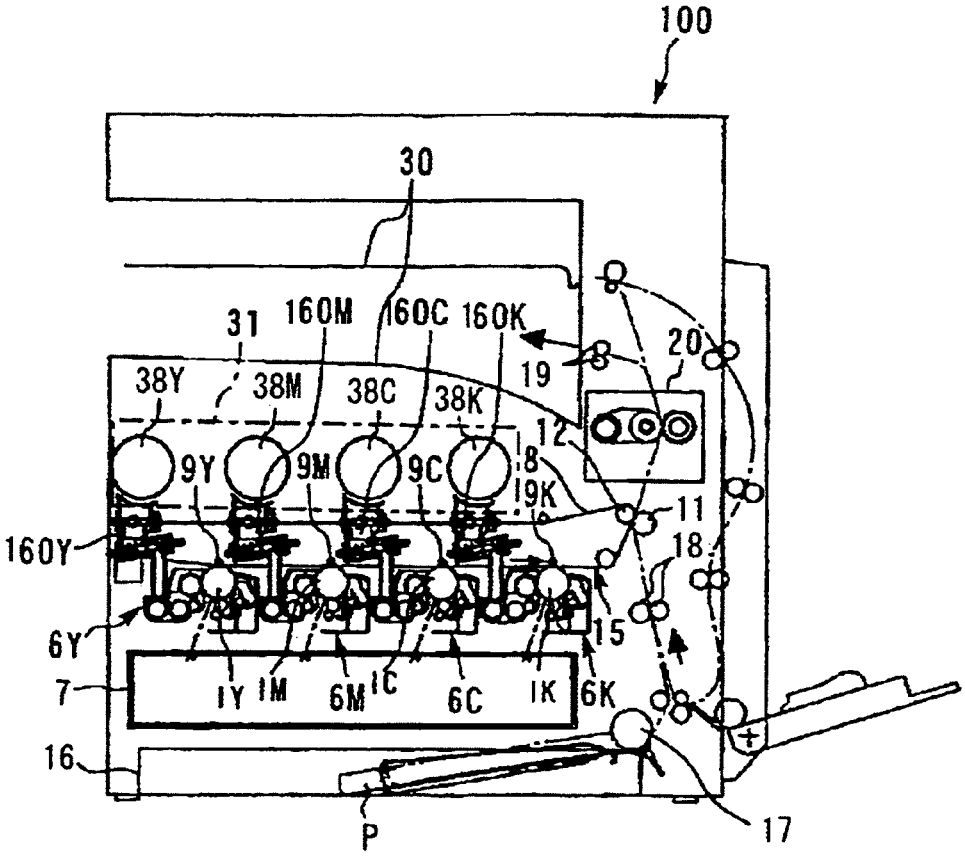
FIG. 1 is a diagram illustrating a schematic configuration of an image forming apparatus according to an embodiment of the present invention.

The present application claims priority to and incorporates by reference the entire contents of Japanese priority documents Japanese Patent Application No. 2010-061671 filed in Japan on Mar. 17, 2010 and Japanese Patent Application No. 2010-061682 filed in Japan on Mar. 17, 2010.

The present application incorporates by reference the entire contents of Japanese priority document Japanese Patent Application No. H07-217694 filed in Japan on Aug. 25, 1995.

Exemplary embodiments of the present invention are described in detail below with reference to the accompanying drawings. In the embodiments, modifications, and the like, configuration elements, such as members or components, identical in function or configuration are designated by identical reference numerals, and repeated descriptions are omitted.

The configuration and operations of an overall image forming apparatus according to an embodiment of the present invention are described below. As illustrated in FIG. 1, four toner containers, or, more specifically, toner containers 38Y, 38M, 38C, and 38K each for a corresponding one of colors (yellow, magenta, cyan, and black) are detachably (in a replaceable manner) arranged in a toner-container storing unit 31 positioned in an upper portion in an image-forming-apparatus main body 100. The toner containers correspond to powder containers. An intermediate transfer unit 15 is arranged below the toner-container storing unit 31. Below an intermediate transfer belt 8 of the intermediate transfer unit 15 aligned along a moving direction of the belt are image forming units 6Y, 6M, 6C, and 6K, each for a corresponding one of the colors (yellow, magenta, cyan, and black).

The toner containers 38Y, 38M, 38C, and 38K housed in the toner-container storing unit 31 are held by toner supply devices 160Y, 160M, 160C, and 160K, respectively. Developers stored in the toner containers 38Y, 38M, 38C, and 38K are each fed (supplied) into a corresponding one of developing devices in the image forming units 6Y, 6M, 6C, and 6K by the toner supply devices 160Y, 160M, 160C, and 160K.

In the present embodiment, a representative one of the image forming units is described below because the image forming units are identical in configuration except for color of the toner. Similarly, a representative one of the toner containers and that of the toner supply devices are described below.

Figure 2:
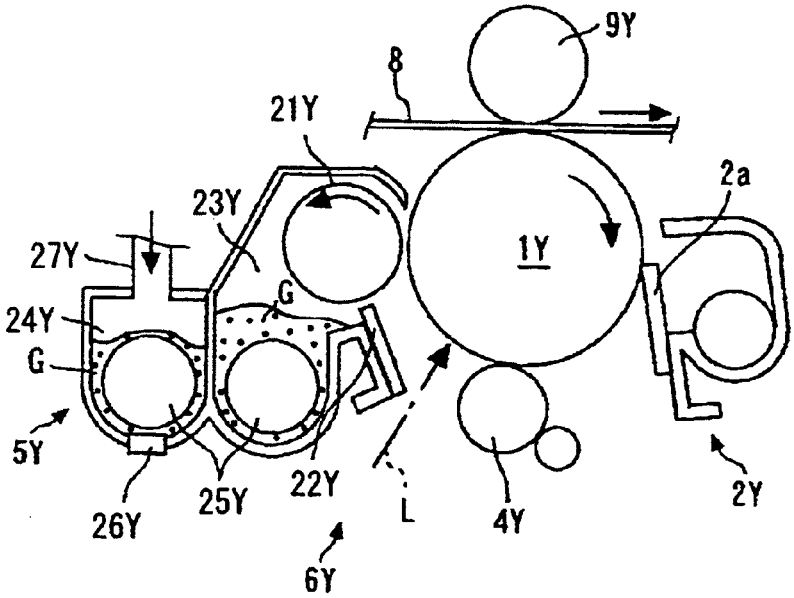
FIG. 2 is a schematic configuration diagram of an image forming unit provided in the image forming apparatus illustrated in FIG. 1.

As illustrated in FIG. 2, the image forming unit 6Y for yellow is configured as a process cartridge including a photosensitive drum 1Y, and, as elements arranged around the photosensitive drum 1Y, an electrostatic charging unit 4Y, a developing device 5Y (developing unit), a cleaning unit 2Y, and an electrostatic discharging unit (not illustrated). The image forming unit 6Y is configured to be detachably mounted on the image-forming-apparatus main body 100. Image forming processes (charging, exposure, developing, transfer, and cleaning) are preformed on the photosensitive drum 1Y to form a yellow image on the photosensitive drum 1Y.

The other three image forming units 6M, 6C, and 6K are substantially identical in configuration with the image forming unit 6Y for yellow but different from the same in color of the toner to be used. An image of a corresponding one of the toner colors is formed by each of the image forming units 6M, 6C, and 6K.

Referring to FIG. 2, the photosensitive drum 1Y is rotated clockwise in FIG. 2 by a driving motor (not illustrated). The surface of the photosensitive drum 1Y is uniformly electrostatically charged at a position where the electrostatic charging unit 4Y is provided (charging).

Thereafter, the surface of the photosensitive drum 1Y reaches a position irradiated with laser light L emitted from an exposure device 7 (see FIG. 1); exposure and scanning are performed at this position, by which an electrostatic latent image for yellow is formed on the surface (exposure). The surface of the photosensitive drum 1Y reaches a position where the surface faces the developing device 5Y; the electrostatic latent image is developed at this position to form a yellow toner image on the surface (developing).

After the developing, the surface of the photosensitive drum 1Y reaches a position where the surface faces the intermediate transfer belt 8 and a primary-transfer bias roller 9Y; the toner image on the photosensitive drum 1Y is transferred to the intermediate transfer belt 8 at this position (primary transfer). At this time, a slight amount of residual toner is left on the photosensitive drum 1Y.

After the primary transfer, the surface of the photosensitive drum 1Y reaches a position where the surface faces the cleaning unit 2Y; the residual toner on the photosensitive drum 1Y is mechanically collected by a cleaning blade 2*a* at this position (cleaning). The surface of the photosensitive drum 1Y reaches a position where the surface faces the electrostatic discharging unit (not illustrated). Residual potential is removed at this position from the photosensitive drum 1Y. The series of the image forming processes performed on the photosensitive drum 1Y is thus completed.

Image forming processes similar to those discussed above are performed on each of the other image forming units 6M, 6C, and 6K. Specifically, laser light L according to image data is emitted from the exposure device 7 arranged in a lower portion in the image forming unit toward each of the photosensitive drums of the image forming units 6M, 6C, and 6K. More specifically, the exposure device 7 emits the laser light L from its light source to illuminate the photosensitive drum 1 with the laser light L through a plurality of optical devices in a manner of scanning the drum by using a polygon mirror being rotated. Thereafter, color toner images each formed on the photosensitive drums 1 through the developing are transferred onto the intermediate transfer belt 8 to be overlaid on one another. Thus, a color image is formed on the intermediate transfer belt 8.

The intermediate transfer unit 15 includes the intermediate transfer belt 8, four primary-transfer bias rollers, or, more specifically, the primary-transfer bias roller 9Y and primary-transfer bias rollers 9M, 9C, and 9K, a secondary-transfer backup roller 12, a plurality of tension rollers, and an intermediate-transfer cleaning unit. The intermediate transfer belt 8 is stretched and supported by a plurality of rollers, and circularly moved in the direction indicated by an arrow in FIG. 1 by rotation of the secondary-transfer backup roller 12.

Each pair of a corresponding one of the primary-transfer bias rollers 9Y, 9M, 9C, and 9K and a corresponding one of the photosensitive drum 1Y and photosensitive drums 1M, 1C, and 1K sandwiches the intermediate transfer belt 8 therebetween to form a primary transfer nip. Transfer bias of opposite polarity to that of toner is applied to the primary-transfer bias rollers 9Y, 9M, 9C, and 9K.

The intermediate transfer belt 8 moves in the direction indicated by the arrow to sequentially pass through the primary transfer nips of the primary-transfer bias rollers. The color toner images on the photosensitive drums 1Y, 1M, 1C, and 1K are thus transferred onto the intermediate transfer belt 8 in a manner that the toner images are overlaid on one another.

The intermediate transfer belt 8, on which the color toner images are transferred and overlaid, reaches the position where the toner images face a secondary transfer roller 11. At this position, the secondary-transfer backup roller 12 and the secondary transfer roller 11 sandwich the intermediate transfer belt 8 therebetween to form a secondary transfer nip. The four-color toner image formed on the intermediate transfer belt 8 is transferred onto a recording medium P, such as transfer paper, that has been conveyed to the secondary transfer nip position. At this time, residual toner having not been transferred onto the recording medium P is left on the intermediate transfer belt 8. The intermediate transfer belt 8 reaches the position where the intermediate-transfer cleaning unit (not illustrated) is provided; the residual toner on the intermediate transfer belt 8 is collected at this position. Thus, a series of the transfer processes performed on the intermediate transfer belt 8 is completed.

Meanwhile, the recording medium P has been conveyed to the secondary transfer nip position from a paper feed unit 16 arranged in a lower portion in the image-forming-apparatus main body 100 via a paper feed roller 17, a pair of registration rollers 18, and the like. More specifically, a plurality of sheets of the recording medium P, such as transfer paper, are stored as being stacked in the paper feed unit 16. When the paper feed roller 17 is rotated counterclockwise in FIG. 1, an uppermost one of the sheets of the recording medium P is fed to a nip between the pair of registration rollers 18.

The recording medium P conveyed to the pair of registration rollers 18 is temporarily stopped at the nip between the pair of registration rollers 18 that has stopped to rotate. Thereafter, the pair of registration rollers 18 is rotated timed to the color image on the intermediate transfer belt 8 to thereby convey the recording medium P to the secondary transfer nip. Hence, a desired color image is transferred onto the recording medium P. The recording medium P, onto which the color image is transferred at the secondary transfer nip position, is conveyed to a position where a fixing unit 20 is provided. Heat and pressure are applied from a fixing belt and a pressure roller onto the recording medium P at this position to fix, to the recording medium P, the color image transferred onto the surface.

After the fixing, the recording medium P is discharged out of the apparatus through a pair of sheet delivery rollers 19. The recording medium P discharged out of the apparatus by the pair of sheet delivery rollers 19 is sequentially stacked, as an output image, on a stacking unit 30. Thus, a series of image printing processes in the image forming apparatus is completed.

The configuration and the operations of the developing device in the image forming unit are described in further detail below with reference to FIG. 2. The developing device 5Y includes a developing roller 21Y that faces the photosensitive drum 1Y, a doctor blade 22Y that faces the developing roller 21Y, two conveying screws 25Y arranged in developer storing units 23Y and 24Y, and a density detection sensor 26Y that detects a toner density in the developer. The developing roller 21Y includes a magnet fixed to the inside of the developing roller 21Y and a sleeve rotating around the magnet. A two-component developer G containing carrier and toner is stored in the developer storing units 23Y and 24Y. The developer storing unit 24Y is in a communicative connection with a toner chute 27Y through an opening defined in an upper portion of the developer storing unit 24Y.

How the developing device 5Y configured as discussed above operates is described below. The sleeve of the developing roller 21Y rotates in a direction indicated by an arrow in FIG. 2. The developer G carried on the developing roller 21Y by magnetic field produced by the magnet moves on the surface of the developing roller 21Y as the sleeve rotates. The developer G in the developing device 5Y is adjusted so that a ratio of toner (toner density) in the developer falls within a predetermined range. More specifically, the toner stored in the toner container 38Y is supplied to the developer storing unit 24Y through the toner chute 27Y according to consumption of the toner in the developing device 5Y.

Thereafter, the toner supplied into the developer storing unit 24Y is circulated (i.e., moves in a direction perpendicular to the plane of FIG. 2) to and from the two the developer storing units 23Y and 24Y by the two conveying screws 25Y while being mixed with the developer G and agitated. The toner in the developer G is electrostatically charged by friction with the carrier and attracted to the carrier; the toner is caused to be carried on the developing roller 21Y together with the carrier by magnetic force produced on the developing roller 21Y.

The developer G carried on the developing roller 21Y is conveyed in the direction indicated by the arrow in FIG. 2 to reach a position where the doctor blade 22Y is provided. At this position, the developer G on the developing roller 21Y is adjusted in its amount, and thereafter conveyed to a position (developing area) where the developer G faces the photosensitive drum 1Y. The toner is attracted to a latent image formed on the photosensitive drum 1Y by the electric field produced in the developing area. Thereafter, the developer G remaining on the developing roller 21Y reaches an upper portion in the developer storing unit 23Y to be separated from the developing roller 21Y at this portion.

The toner supply devices 160Y, 160M, 160C, and 160K and the toner containers 38Y, 38M, 38C, and 38K are described below. The toner supply devices are identical with one another in configuration except for color of the developer in the toner container loaded thereon. The same holds true for the toner containers. Accordingly, a single toner supply device 160 and a single toner container 38, with reference symbol Y, M, C, or K for use in identifying a toner color omitted therefrom, are described below. The developer to be stored in the toner container is not limited to the toner alone; the developer can alternatively be a mixture of toner and carrier or carriers alone.

Figure 3:
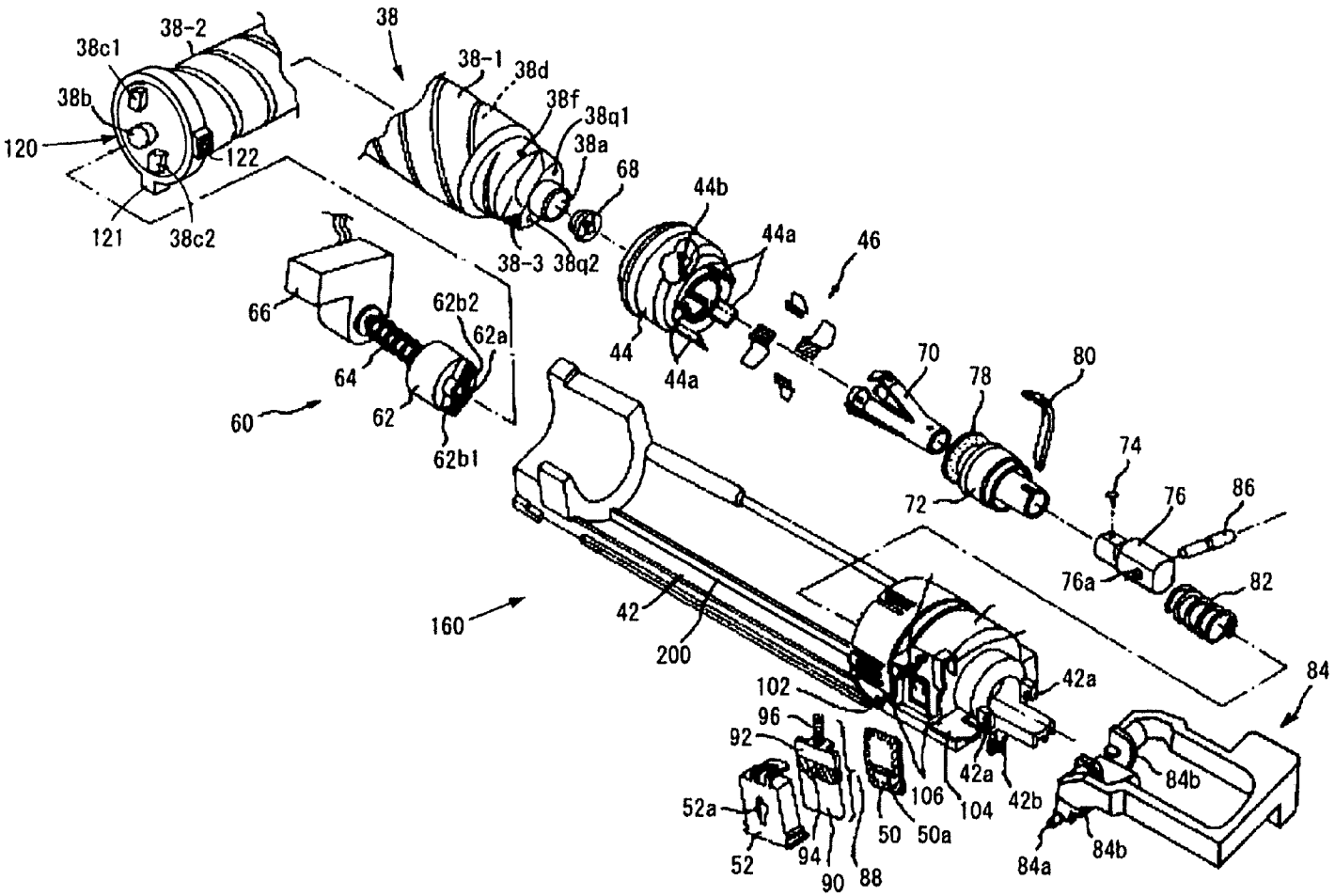
FIG. 3 is a schematic exploded perspective view of a developer supply device provided in the image forming apparatus illustrated in FIG. 1.

FIG. 3 is a schematic exploded perspective view illustrating parts structure of the toner supply device 160. The toner container 38 is rotated by a driving unit 60 fixed to a rear wall panel 58 (FIG. 5, FIG. 6) of the image-forming-apparatus main body 100. The driving unit 60 includes a joint 62, a spring 64, and a casing 66 that incorporates a motor and a shaft. A recess 62*a* and projections 62*b*1 and 62*b*2 are provided on a leading end of the joint 62. Conforming thereto, a center portion 38*b* and axial protrusions 38*c*1 and 38*c*2 are provided on a bottom portion 38-2 (rear end) of the toner container 38. The center portion 38*b* includes a cylindrical protrusion to be caught in the recess 62*a* in the joint 62. Each of the axial protrusions 38*c*1 and 38*c*2 includes a prismatic protrusion to be fitted in a side surface of a corresponding one of the projections 62*b*1 and 62*b*2. When the center portion 38*b* is fit in the recess 62*a*, the position of the bottom portion 38-2 of the toner container 38 is held; engagement of the axial protrusions 38*c*1 and 38*c*2 with the projections 62*b*1 and 62*b*2 allows the toner container 38 to rotate. As illustrated in FIG. 6, when the joint 62 of the driving unit 60 is rotated in a direction indicated by arrow E, the toner container 38 is also rotated in the same direction.

The toner container 38 illustrated in FIG. 3 is made of synthetic resin, such as polyethylene terephthalate, polyethylene, polypropylene, or polyethylene+polycarbonate. A helical groove extending from the bottom portion 38-2 toward a discharge port 38*a* is defined in an inner wall of the toner container 38. By the helical groove defined in the inner wall, a helical groove 38*d* is provided in an outer peripheral surface of the toner container 38. When the toner container 38 is rotated, toner is guided by the helical groove 38*d* and discharged through the discharge port 38*d*. A cap 68 for preventing the toner from being discharged during a period where the toner container 38 is not used is detachably attached to the discharge port 38*a*.

A plurality of rib 44*a* are formed on and integral with a leading edge portion of a bottle holding member 44. Extruding members 46 are adhered to the ribs 44*a* with pressure sensitive adhesive double coated tapes or the like. The extruding members 46 are made of an elastic material, such as Mylar or rubber. A rib 44*b* is formed on an inner wall of the bottle holding member 44 at a portion facing an end surface of an intermediate portion 38-3 of the toner container 38.

A container body 38-1, which is a cylindrical large-diameter portion of the toner container 38, and the discharge port 38*a*, which is tapered, is connected with the intermediate portion 38-3, which has an intermediate diameter, interposed therebetween. Driving claws 38*q*1 and 38*q*2 are formed on an end surface, what is called a shoulder portion, of the intermediate portion 38-3 on the side near to the discharge port. These driving claws 38*q*1 and 38*q*2 engage with the rib 44*b* to allow the bottle holding member 44 to be rotated by rotation of the toner container 38.

Reference numeral 70 denotes a collet chuck that grips and releases the cap 68. The collet chuck 70 is incorporated in a cylindrical casing 72 and integrally coupled to a shaft 76 with a screw 74. Reference numeral 78 denotes a seal, 80 denotes a sealing member, and 82 denotes a coil spring that constantly urges a group of components including the collet chuck 70, the cylindrical casing 72, and the shaft member 76 toward the toner container 38. These components are assembled and held in a toner hopper unit 40. Reference numeral 84 denotes a handle for use in turning the cap 68 open and close. Shaft portions 84*a* formed integral with the handle 84 are supported by shaft holes 42*a* defined in a leading-end portion of a toner cradle 42, thereby allowing the handle 84 to rotate.

Reference numeral 86 denotes a sliding shaft to be inserted into a hole 76*a* defined in the shaft member 76 and in contact with cams 84*b* provided on the handle 84. When the handle 84 is rotated in a direction indicated by arrow F in FIG. 6 and the group of components including the collet chuck 70 are slid in a direction away from the toner container 38, the cap 68 comes out of the discharge port 38*a*, allowing toner in the toner container 38 to be discharged into the toner hopper unit 40.

A shutter for opening and closing a toner supply port 54 and the like are described below. A supply-amount regulating member 50 provided at an opening 48 in the toner hopper unit 40 is made of an elastic material, such as Mylar or rubber, and has a slit 50*a* (elongated rectangular hole) as illustrated in FIG. 3. By adjusting the width of the slit 50*a*, an amount of toner to be supplied is adjusted to an appropriate amount. The supply-amount regulating member 50 is adhered to the opening 48 with a pressure sensitive adhesive double coated tape or the like.

A shutter 88 that opens and closes the toner supply port 54 is provided at a portion inside a toner inlet cover 52 (FIG. 4) mounted outside of the opening 48 in a way that the shutter 88 is vertically movable, or, put another way, in an orientation perpendicular to (i.e., intersecting with) the toner supply port 54 that is horizontally open. The shutter 88 includes an elastic member 90 serving as a shutter body that can be bent, a support 92 that supports the elastic member 90, and a cylindrical protrusion 94 integrally formed with the support 92. The support 92 includes a spring 96 that constantly urges the shutter 88 to close the shutter 88. In the present embodiment, the elastic member 90 is made of polyester film, such as Mylar, and adhered to the support 92 with a pressure sensitive adhesive double coated tape or the like. A for-movement hole 52*a* that allows the protrusion 94 to move is defined in the toner inlet cover 52.

Figure 4:
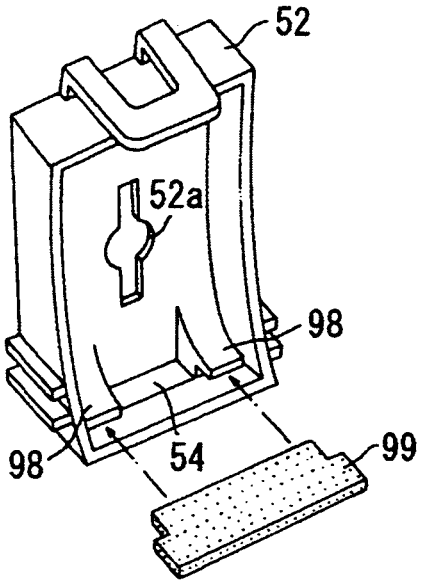
FIG. 4 is a schematic exploded perspective view of a toner inlet cover.

As illustrated in FIG. 4, the toner supply port 54 is defined in a bottom surface of the toner inlet cover 52; in addition, arcuate guide portions 98, 98 that guide the elastic member 90 of the shutter 88 are formed integral with the toner supply port 54. A foamed-plastic sealing member 99 serving as an elastic sealing member, into which a tip of the elastic member 90 is to be jammed to prevent toner scattering, is provided at a distal end portion of the guide portions 98. Referring to FIG. 3, reference numeral 104 near the opening 48 denotes a second guide rib having a trapezoidal shape and projecting in the horizontal direction to move the shutter whereas 106*s* denote deformation-restricting guides supporting a rear surface of the elastic member 90.

Figure 5:
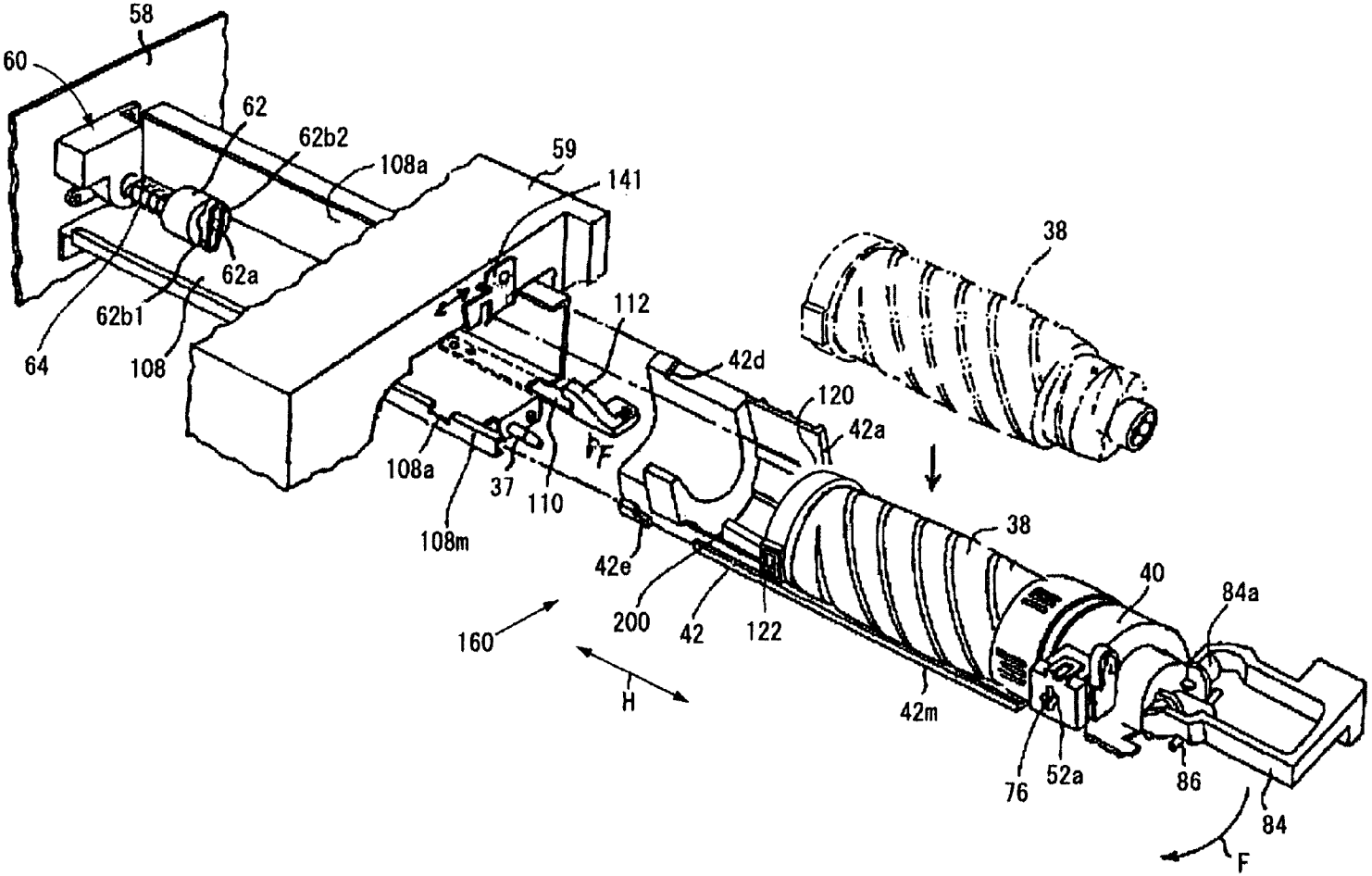
FIG. 5 is a schematic exploded perspective view of the developer supply device.
Figure 6:
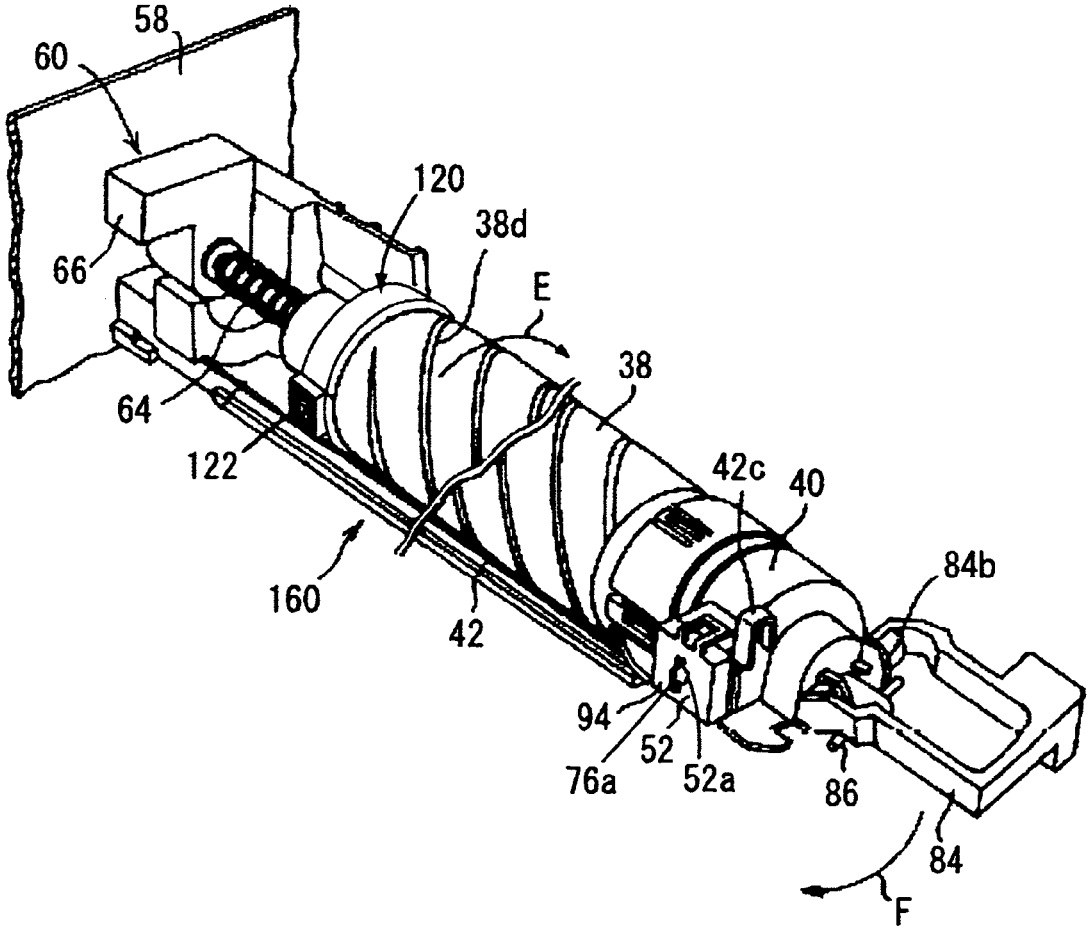
FIG. 6 is a schematic perspective view of the developer supply device with a powder container mounted thereon.

As illustrated in FIG. 5, the toner cradle 42 can be detachably mounted by being guided by a guide plate 108 in a direction indicated by arrow H. The guide plate 108 is fastened to a rear wall panel 58 of the image-forming-apparatus main body and to a front wall panel 59 of the image-forming-apparatus main body with screws (not illustrated). A stopper 112 for preventing slip off is provided at a leading end of the guide plate 108 and supported by a leaf spring 110 fixed to the guide plate 108. The toner supply device 160 is to be mounted in a state where the stopper 112 is pushed down. When the stopper 112 is released after the toner supply device 160 has been mounted, the stopper 112 engages with a leading end of the toner cradle 42, causing the toner supply device 160 to be held in such a slip-off-prevented state as illustrated in FIG. 6.

FIG. 5 illustrates a state where the toner supply device 160 has been pulled out of the guide plate 108. In an assembled state, side portions 42*m* and 42*n* fit in guides 108*m* and 108*n* of the guide plate 108. The toner container 38 is mounted on and removed from the toner supply device 160 with the toner cradle 42 pulled out to a position close to that illustrated in FIG. 5. Prevention against slip off of the toner supply device 160 at this time is achieved by, as illustrated in FIG. 5, causing a stepped portion 42*e* formed on the toner cradle 42 to be caught in a notch 108*a* provided in the guide plate 108. A stepped portion 42*d* is caught in a notch in the guide 108*n*; however, this notch is behind the front wall plate 59 and hence not illustrated.

As illustrated in FIG. 5, in a state where the toner container 38 is placed on the toner cradle 42, the toner supply device 160 is pushed into the image-forming-apparatus main body to load the toner supply device 160 thereon. Before the toner supply device 160 is pushed in, the shutter 88 is urged by the spring 96 to thereby close the toner supply port 54 defined at the bottom of the toner inlet cover 52, and the elastic member 90 is curved along the arcuate guide portions 98 and jammed, at the leading end of the elastic member 90, into the foamed-plastic sealing member 99. Therefore, space between the opening 48 in the toner hopper unit 40 and the toner supply port 54 is sealed in a leak-proof manner.

When, from this state, push-in of the toner supply device 160 is performed, a cylinder portion of the protrusion 94 formed integral with the support 92 is brought into contact with a guide rib formed on a body portion of the image forming unit 6 and pushed up against the tension applied by the sprint 96. The cylindrical portion is eventually stopped at a flat top portion of the guide rib. Along with this movement, the elastic member 90 is also elevated (retracted) along the guide portions 98, which opens the toner supply port 54 and brings a developing device 5 and the toner supply device 160 into a communicatively connected state. When the toner supply device 160 is pulled out, the protrusion 94 is lowered. Accordingly, the shutter 88 is urged by the spring 96 to automatically move in a closing direction, and the elastic member 90 that has been vertically oriented is curved along the toner supply port 54, placing the shutter 88 in a closed state.

When the toner supply port 54 and a toner receiving port (not illustrated) are open, or, put another way, in a state where the toner supply device 160 and the process cartridge (the image forming unit 6) are mounted on the image-forming-apparatus main body 100, positioning to the intermediate portion 38-3 of the toner container 38 is made by contacting engagement between a spherical small protrusion 38*f* and an inner-radius portion of the bottle holding member 44, and abutment of the small protrusion 38*f* on the rib 44*b* of the bottle holding member 44 engaged with the toner hopper unit 40.

When, as illustrated in FIG. 6, the handle 84 is pivoted downward in a direction indicated by arrow F from this state, the cams 84*b* (FIG. 3) pull the sliding shaft 86 toward the front side of the apparatus. This also moves the shaft 76 and brings the collet chuck 70 into contact with a protrusion (not illustrated) provided on the cylindrical casing 72. Hence, the collet chuck 70 starts closing, thereby gripping the cap 68. When the shaft 76 is further moved in the H direction, the collet chuck 70 removes the cap 68 from the toner container 38, allowing the toner in the toner container 38 to flow into the toner hopper unit 40 assembled on the toner cradle 42.

Toner supply is performed based on a density of the toner in the developing device 5 determined with a toner density sensor 26. When the detected value drops to be equal to or lower than a reference density, the driving unit 60 is activated to rotate the joint 62 in the direction indicated by arrow E as illustrated in FIG. 6. This brings the joint 62 into engagement with the bottom portion of the toner container 38, causing the toner container 38 to rotate in the same direction. When the toner container 38 is rotated, toner is discharged through the discharge port 38*a* and accumulated in the toner hopper unit 40. Meanwhile, when the toner container 38 is rotated, the driving claws 38*q*1 and 38*q*2 formed on the end surface of the intermediate portion 38-3 on the side near to the discharge port engage with the rib 44*b* that is integral with the bottle holding member 44, and press and move the rib 44*b*. This causes the extruding members 46 integral with the bottle holding member 44 to rotate while sliding on an inside wall surface of the toner hopper unit 40. The toner accumulated in the toner hopper unit 40 is scraped off by this rotation of the extruding members 46.

When the extruding members 46 pass through the slit in the supply-amount regulating member 50, the toner is squeezed out through the slit. The thus-squeezed toner falls inside the toner inlet cover 52 and passes through the toner supply port 54, which is located in the lower portion in the toner inlet cover 52 and open, and passes through the toner receiving port (not illustrated) to be supplied into the developing device 5.

As discussed above, the toner supply device 160 according to the present embodiment allows replacement of the toner container 38 without causing toner leakage out of the discharge port 38*a* in the toner container 38 to occur.

Figure 7:
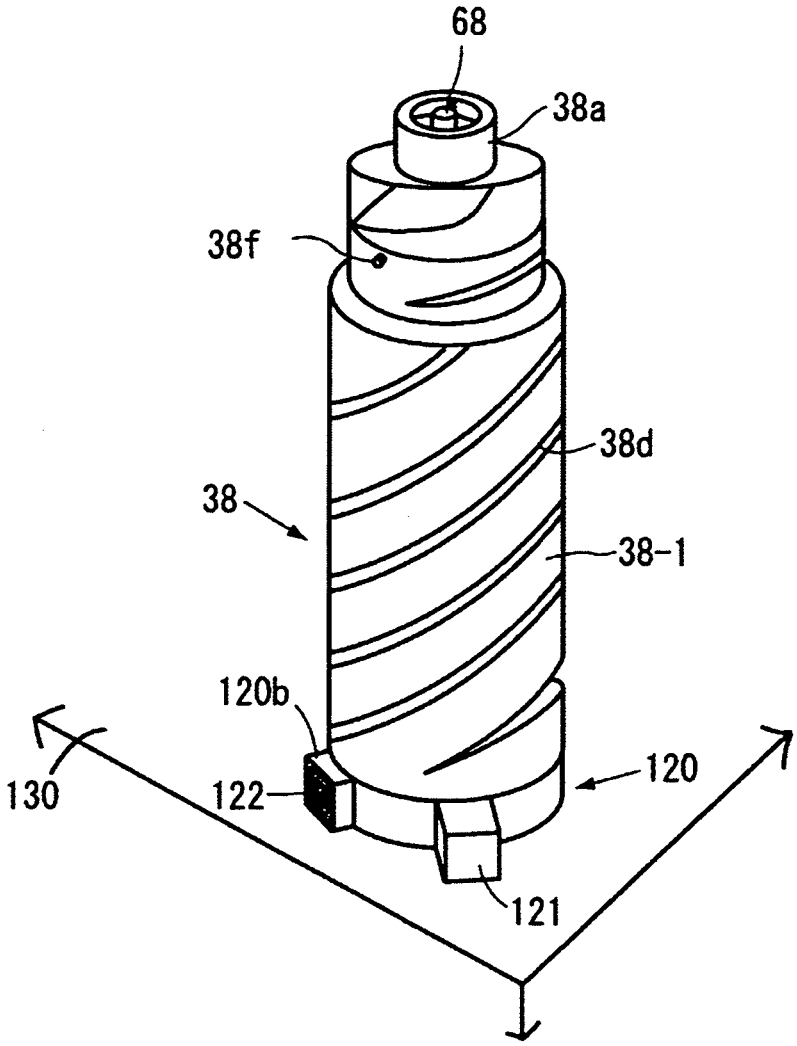
FIG. 7 is a schematic diagram illustrating the configuration of the powder container according to the embodiment.

The configuration of the toner container 38 is described below. As illustrated in FIG. 7, the toner container 38 includes, as already mentioned above, the cylindrical container body 38-1, the discharge port 38*a*, the retainer and a ring member 120 that are rotatable relative to the container body 38-1 and hold an RFID 122 corresponding to the information recording device, and a positioning member 121. The discharge port 38*a* is provided at one end of the container body 38-1 to allow the toner in the container body to be discharged out of the container body therethrough. The RFID 122 is capable of carrying out contactless communications. The positioning member 121 engages with the image-forming-apparatus main body (the toner supply device 160) side when the toner container 38 is loaded on the toner supply device 160 arranged on the image-forming-apparatus main body 100. Information about a toner color, an amount of the toner, a serial number (production lot) of the toner, and date of manufacture of the toner, and information pertaining to reuse of the toner container 38, such as number of reused times, reused date(s), and a company performed reusing operation, and the like are stored in the RFID 122.

Figure 8:
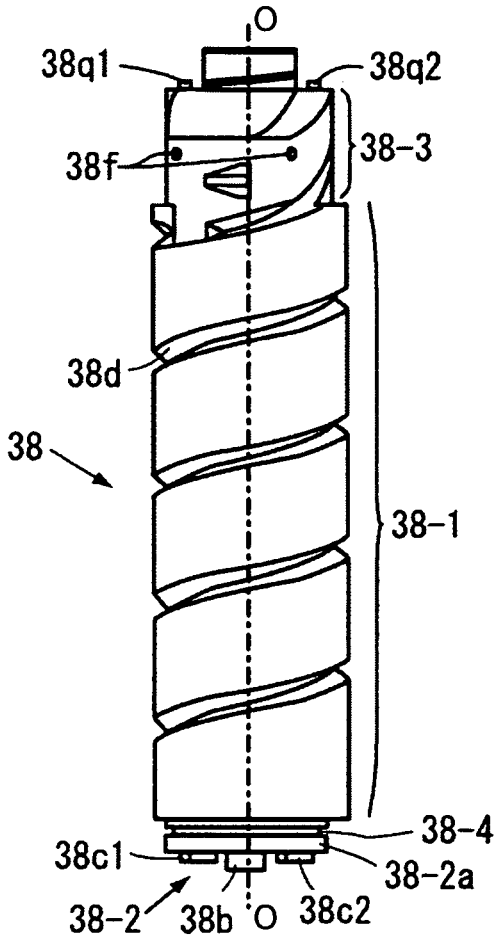
FIG. 8 is a schematic diagram illustrating the configuration of a container body of the powder container.

As illustrated in FIG. 8, the container body 38-1 is sealed at the other end, or the bottom portion 38-2. The discharge port 38*a* is tapered to the container body 38-1 on the side opposite from the bottom portion 38-2. Although the toner container 38 is illustrated with the discharge port 38*a* arranged on the top side in FIGS. 7 and 8 for convenience, the toner container 38 is actually oriented such that the discharge port 38*a* is horizontally open as illustrated in, for instance, in FIGS. 3, 5, and 6 during use. Accordingly, when the toner container 38 is rotated, the toner in the toner container 38 is guided by the helical groove 38*d* and delivered through the discharge port 38*a* to the outside.

As illustrated in FIG. 8, the axial protrusions 38*c*1 and 38*c*2, each being a prismatic protrusion, are provided to transmit rotary force to the toner container at an outer radius portion in the bottom portion 38-2 away from a center axis O-O of the cylindrical shape. The axial protrusions 38*c*1 and 38*c*2 are prismatic protrusions in this example; however, the shape of the axial protrusions 38*c*1 and 38*c*2 is not limited thereto, and can have any shape that allows easy engagement with the projections 62*b*1 and 62*b*2, which are driving sources of the rotary force, provided in the toner supply device 160.

As discussed above, the axial protrusions 38*c*1 and 38*c*2 are formed on the bottom portion 38-2 side of the toner container 38 rather than on the one end, through which the toner is to be discharged. This allows runout of the toner container 38 on the discharge port 38*a* side to be minimized. In this configuration, the two axial protrusions 38*c*1 and 38*c*2 are arranged at positions equidistantly away from the center axis O-O so that a rotary force close to a couple is exerted. This configuration prevents the toner container 38 from receiving a radially outward force during rotation, thereby eliminating or reducing the necessity for providing a countermeasure against unintended popout of the toner container 38. Accordingly, reliable toner supply can be achieved with the relatively simple configuration.

Figure 9:
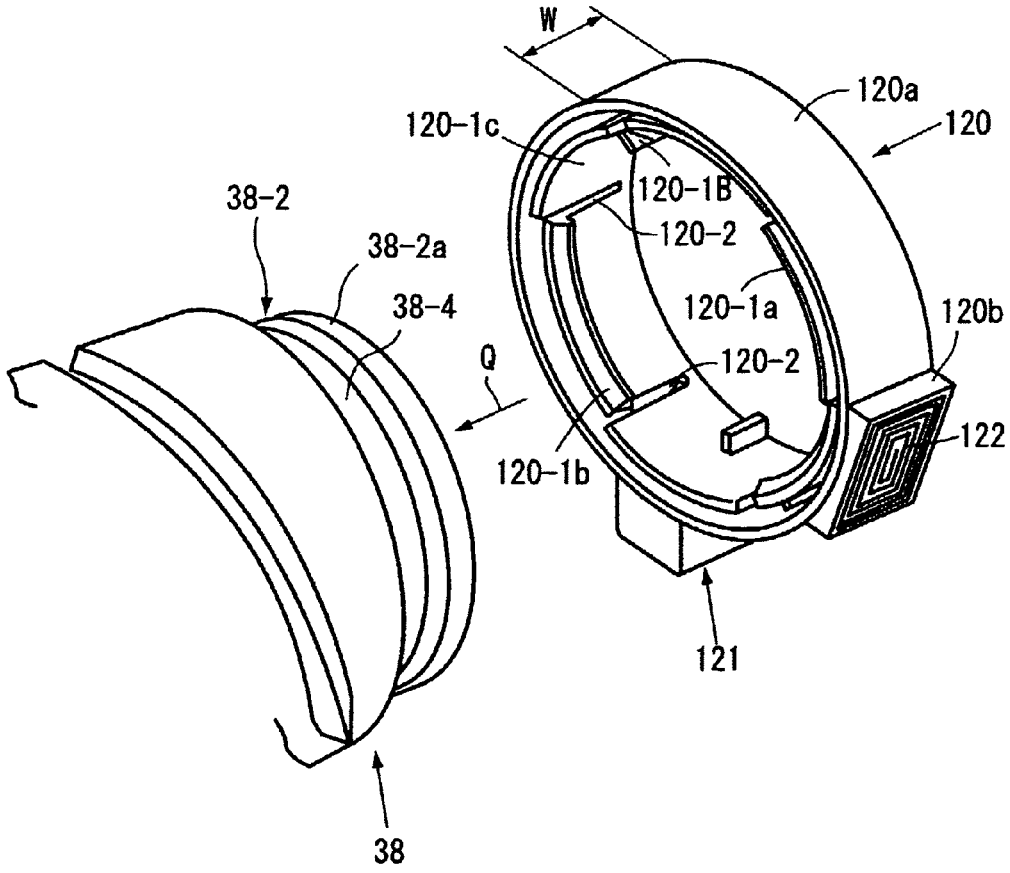
FIG. 9 is a schematic perspective view illustrating a retainer including an information recording device and a bottom portion of the powder container.
Figure 10A:
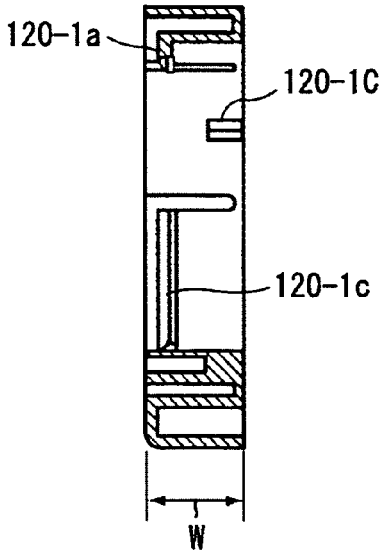
FIG. 10A is a schematic cross-sectional view taken along a line P-P of FIG. 10B.
Figure 10B:
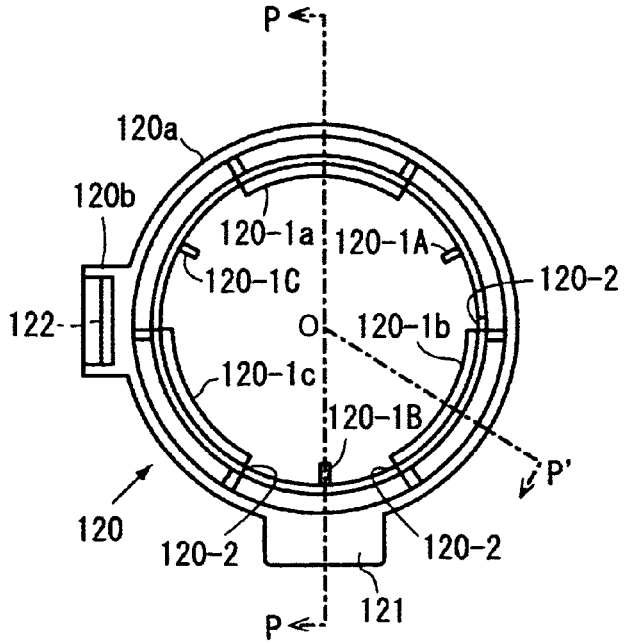
FIG. 10B is a front view of the retainer.

As illustrated in FIGS. 9 to 10B, the ring member 120 is configured to be fitted into the bottom portion 38-2 of the toner container 38, rather than into the toner discharge port 38*a*, in a manner that the ring member 120 is rotatable and that even when the ring member 120 is rotated, the ring member 120 is not misaligned relative to the toner container 38 in an axial, longitudinal direction. FIG. 10A is a schematic cross-sectional view taken along a line P-P of FIG. 10B. A fitting unit that causes the ring member 120 to be fitted into the toner container 38 without deviation includes, referring to FIGS. 9 to 10B, a protruding outer-diameter portion 38-2*a* formed on the bottom portion 38-2, three elastic claws, or, more specifically, elastic claws 120-1*a*, 120-1*b*, and 120-1*c* formed on an inner radius portion of the ring member 120, and three stoppers, or, more specifically, stoppers 120-1A, 120-1B, and 120-1C formed on the inner radius portion of the ring member 120. As illustrated in FIG. 8, a groove 38-4 is defined between the protruding outer-diameter portion 38-2*a* and the container body 38-1.

The three elastic claws 120-1*a*, 120-1*b*, and 120-1*c* are equidistantly located on an inner circumference of the ring member 120. Each of the elastic claws 120-1*a*, 120-1*b*, and 120-1*c* is a cantilever-type elastic member having one end that is formed integral with the body of the ring. Stopper holding members, which are also of a cantilever type, are individually interposed between adjacent ones of the elastic claws 120-1*a*, 120-1*b*, and 120-1*c*. The stoppers 120-1A, 120-1B, and 120-1C are formed on the three stopper holding members. Although being slotted and therefore divided at their basal end portions, as a whole, the elastic claws 120-1*a*, 120-1*b*, and 120-1*c* and the stopper holding members form a circular inner circumferential surface. The elastic claws 120-1*a*, 120-1*b*, and 120-1*c* and the stopper holding members are configured in terms of dimensions such that, in a state of being fitted into the outer circumferential surface of the protruding outer-diameter portion 38-2*a*, the elastic claws 120-

1*a*, 120-1*b*, and 120-1*c* and the stopper holding members are rotatable in a sliding manner without deviation during rotation.

Each of the elastic claws 120-1*a*, 120-1*b*, and 120-1*c* has, at its free end, a hook-shaped portion that is inwardly bent. The ring member 120 can be rotatably mounted on the toner container 38 by pressing the ring member 120 into the protruding outer-diameter portion 38-2*a* as indicated by arrow Q in FIG. 9. In the course of mounting of the ring member 120, the three elastic claws 120-1*a*, 120-1*b*, and 120-1*c* are warped at their free end portions, causing the hook-shaped portions of the elastic claws 120-1*a*, 120-1*b*, and 120-1*c* to climb over the protruding outer-diameter portion 38-2*a* and enter the groove 38-4. At this time, the three elastic claws 120-1*a*, 120-1*b*, and 120-1*c* and the stoppers 120-1A, 120-1B, and 120-1C sandwich the protruding outer-diameter portion 38-2*a* with a clearance that allows sliding therebetween. Hence, once the ring member 120 has been fitted into the toner container 38, it is not easy to remove the ring member 120. This is a measure for causing the ring member 120 to satisfactorily function. To disable disassembling, a right-angled bent portion that conforms to a corner, which is a right-angled portion, of the protruding outer-diameter portion 38-2*a* is formed on each of the three elastic claws 120-1*a*, 120-1*b*, and 120-1*c*. The bent portions fit the right-angled portion of the protruding outer-diameter portion 38-2*a*, thereby preventing slip off in the axial direction and performing the function of disabling disassembly.

The toner container 38 is allowed to rotate relative to the ring member 120 but will not be deviated in the axial direction because the protruding outer-diameter portion 38-2*a* is interposed between the three elastic claws 120-1*a*, 120-1*b*, and 120-1*c* and the stoppers 120-1A, 120-1B, and 120-1C.

Figure 11:
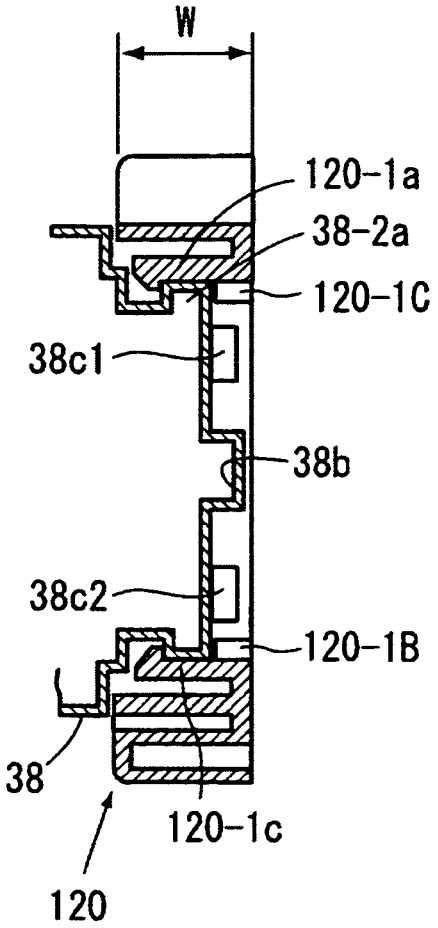
FIG. 11 is a schematic cross-sectional view of the retainer mounted on the container body.

Referring to FIG. 11, the ring member 120 faces, at its one end, an edge portion of the container body 38-1 of the toner container 38 in close proximity thereto; the protruding outer-diameter portion 38-2*a* has a diameter smaller than a diameter of the container body 38-1; an end surface portion, of the toner container 38, connecting between the protruding outer-diameter portion 38-2*a* and the container body 38-1 covers the elastic claws 120-1*a*, 120-1*b*, and 120-1*c*. It is not allowed to externally operate the three elastic claws 120-1*a*, 120-1*b*, and 120-1*c* because the toner container 38 in this state is unmovable in the axial direction relative to the ring member 120 as discussed above. Accordingly, disassembly of the ring member 120 is practically disabled. If an attempt of forcibly disassembling the ring member 120 by application of an externally force is made, the protruding outer-diameter portion 38-2*a* of the toner container 38 will be damaged.

The reason why disassembly of the ring member 120 from the toner container 38 is disabled is that, as will be discussed later, the ring member 120 has at least any one of non-interchangeability, a freestanding function, and a rotation-preventing function and therefore it is highly desirable to maintain the relationship where the ring member 120 and the toner container 38 are integral with each other.

The ring member 120 has a predetermined width W in the axial, longitudinal direction. FIG. 11 is a schematic cross-sectional view of the ring member 120 fitted into the protruding outer-diameter portion 38-2*a* of the toner container 38 taken along a line P-O-P in FIG. 10B. As illustrated in FIG. 11, the predetermined width, W, is determined such that, in the assembled state, the one end of the ring member 120 is in contact with an end surface of the container body 38-1 of the toner container 38 whereas the other end of the ring member 120 is located outside than the center portion 38*b*. Put another way, the surface of the ring member 120 on the other end is positioned higher than the surface of the center portion 38*b*. Accordingly, not only the center portion 38*b* but also the axial protrusions 38*c* 1 and 38*c*2 are positioned inside than the other end of the ring member 120.

This configuration allows the toner container 38, to which the ring member 120 is attached, to stand upright on a flat surface, such as a table 130, as illustrated in FIG. 7. If the ring member 120 configured as discussed above is not attached to the toner container 38, standing the toner container 38 as illustrated in FIG. 7 cannot be achieved because the center portion 38*b* protrudes out from the bottom of the toner container 38. In this case, the toner container 38 is to be laid sideways during replacement of the toner container or the like. However, the toner container 38 can fall from a table or the like to a floor during replacement of the toner container or the like because the cylindrical toner container 38 is apt to roll. In contrast, when the ring member 120 is combined with the toner container 38 as in the present embodiment, the toner container 38 can stand upright stably, leading to reduction in chances of accidental falling.

Referring to FIG. 9, the positioning member 121, which is a radially protruding fixed member, is formed on an outer circumferential surface of the ring member 120. The geometry of the positioning member 121 is determined such that the positioning member 121 engages with a stopper 200 formed on the toner cradle 42 of the toner supply device, being the image-forming-apparatus main body side, illustrated in FIGS. 12A and 12B. In this example, the positioning member 121 assumes a rectangular-solid shape. The stopper 200 formed on the toner cradle 42 have the geometry of a rectangular to receive the positioning member 121 fit therein.

A receptacle 120*b* for receiving the RFID 122 inserted thereinto is provided on an outer peripheral surface 120*a* of the ring member 120 in a manner projecting outward from the outer peripheral surface 120*a*. Any way for mounting the RFID 122 on the ring member 120 can be employed so long as the way does not affect operations of the RFID 122. Examples of the way include adhering the RFID 122 to the ring member 120 with an adhesive and covering the receptacle 120*b*, into which the RFID 122 is inserted, with a sticker (not illustrated). The RFID 122 can be bonded to the ring member 120 by applying heat sealing from outside of the RFID 122.

Figure 12A:
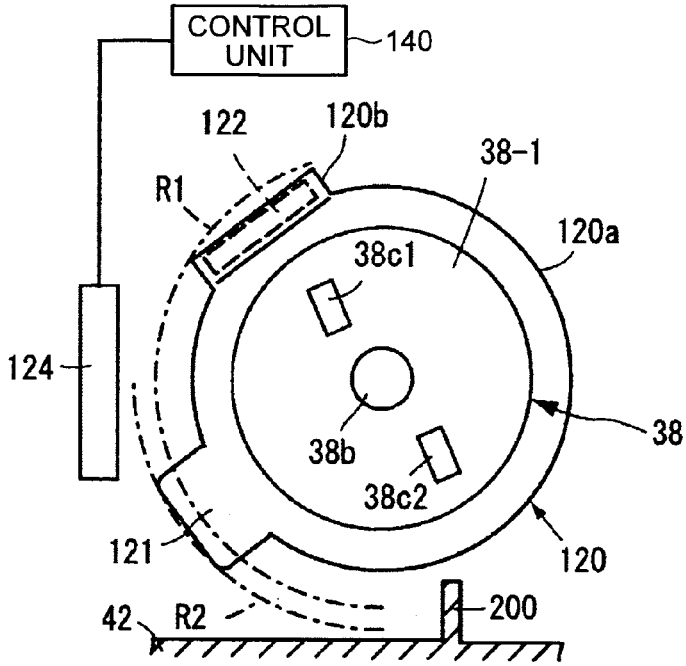
FIG. 12A is a schematic diagram illustrating a state where the powder container is mounted on an image-forming-apparatus main body.

As illustrated in FIG. 12A, a movement path R1 of an outermost-radius portion of the receptacle 120*b* is positioned inside than a movement path R2 of an outermost-radius portion of the positioning member 121. Put another way, a protruding length, by which the receptacle 120*b* protrudes from the outer peripheral surface 120*a*, is smaller than a protruding length of the positioning member 121 from the outer peripheral surface 120*a*. Accordingly, even when a configuration where the receptacle 120*b* protrudes out from the outer peripheral surface 120*a* is employed, interference between the receptacle 120*b* and components arranged near the ring member 120 can be prevented, and simultaneously upsizing can be avoided because the protrusion of the receptacle 120*b* from the outer peripheral surface 120*a* is positioned inside the positioning member 121.

Figure 12B:
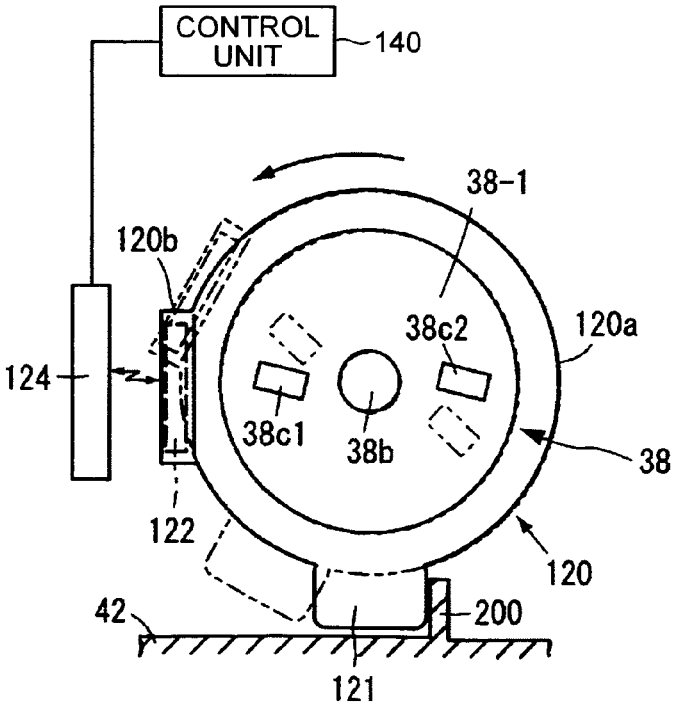
FIG. 12B is a diagram illustrating a state where the powder container is rotated and positioned.

As illustrated in FIG. 12B, the RFID 122 is arranged such that when the positioning member 121 is in contact with the stopper 200, the RFID 122 is located at a position where the RFID 122 faces an antenna 124, being an information communication unit, provided on the image-forming-apparatus main body 100 side and where the RFID 122 can carry out communications with the antenna 124. The antenna 124 is connected to a control unit 140.

According to such a configuration, the ring member 120 holding the RFID 122 is rotatable relative to the container body 38-1 and provided with the positioning member 121 for use in positioning relative to the main body when the toner container 38 is loaded on the image-forming-apparatus main body 100. Accordingly, even if the toner container 38 is loaded on the image-forming-apparatus main body 100 without performing positioning of the toner container 38, when the container body 38-1 having been loaded is rotated by the driving unit 60 illustrated in FIGS. 3, 5, and 6 in a mounting direction, the ring member 120 is also rotated together with the container body 38-1 by friction drag. When the positioning member 121 comes into contact with the stopper 200, the ring member 120 is prevented from further rotating; however, the container body 38-1 is rotated to the position. Rotation of the container body 38-1 is stopped when the driving unit 60 is stopped. This not only facilitates positioning of the RFID 122 to the position where communications with the antenna 124 can be carried out but also allows the antenna 124 to read information from the RFID 122 reliably.

Put another way, this allows a user to mount the toner container 38 on the toner cradle 42 of the toner supply device 160 with no consideration of the position of the RFID 122; after the toner container 38 has been mounted, this allows the RFID 122 to be located at the optimum position to exchange information according to toner-discharging operation performed by the toner container 38. Hence, the RFID 122 can be located to the optimum position for information exchange without fail irrespective of the toner-discharging operation performed by the toner container 38. This substantially completely prevents the RFID 122 from being affected by toner that would otherwise stick thereto.

Figure 13A:
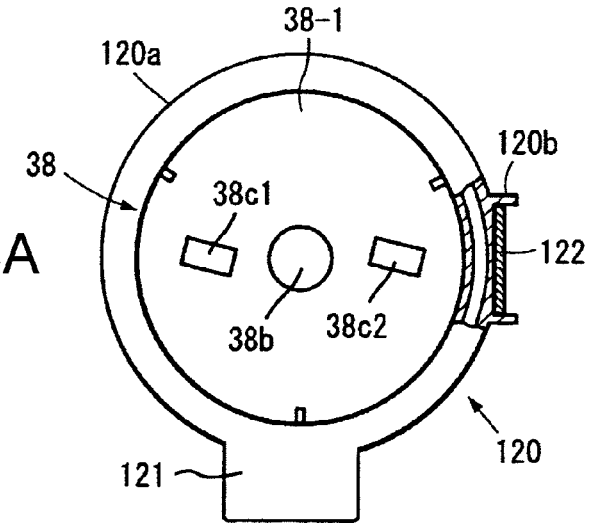
FIG. 13A is a schematic partially exploded view of the retainer with the information recording device arranged in a receptacle protruding from an outer peripheral surface of the retainer.

The ring member 120 may be provided on the toner container 38 in any form so long as it does not affect operations of the RFID 122. In the embodiment, as illustrated in FIG. 13A, the RFID 122 is arranged inside the receptacle 120*b* formed on the outer peripheral surface 120*a* of the ring member 120 such that the receptacle 120*b* protrudes from the outer peripheral surface 120*a*. This configuration allows the RFID 122 to be externally inserted into the receptacle 120*b*, thereby greatly facilitating mounting of the RFID 122 during assembly.

Figure 13B:
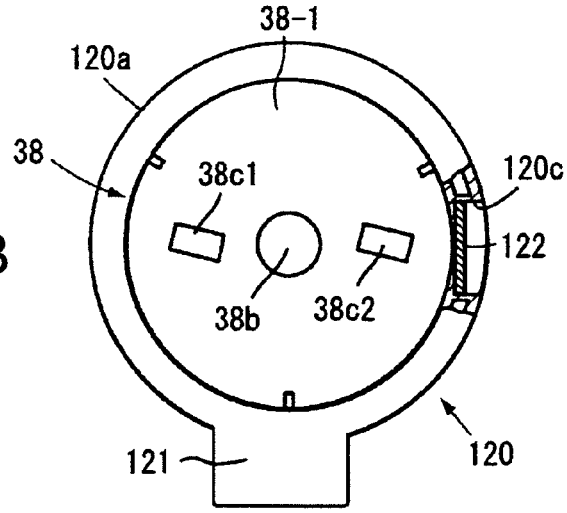
FIG. 13B is an enlarged cross-sectional view of the retainer with the information recording device arranged in a recess provided in the outer peripheral surface of the retainer.

As a modification, the RFID 122 can be arranged inside a recess 120*c* defined in the outer peripheral surface 120*a* of the ring member 120 as illustrated in FIG. 13B rather than providing a protrusion protruding from the outer peripheral surface 120*a*.

Figure 13C:
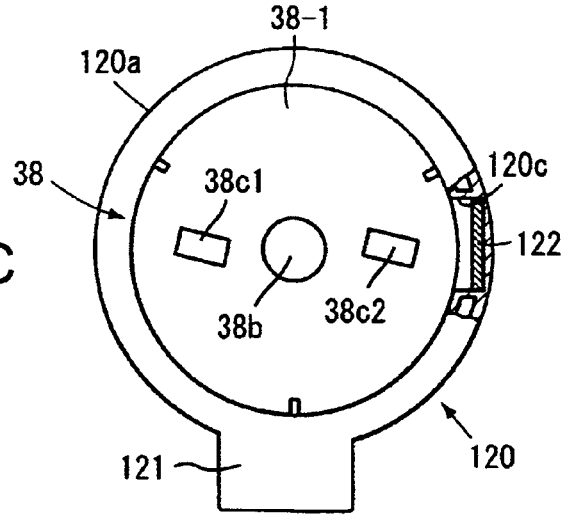
FIG. 13C is an enlarged cross-sectional view of the retainer with the information recording device arranged in a recess provided in an inner circumferential surface of the retainer.

When constructed in this manner, the outer peripheral surface 120*a* of the ring member 120 can have not only a smooth outer surface but also have a small diameter, which contributes to compact configuration. In a modification illustrated in FIG. 13C, the recess 120*c* is defined in the inner circumferential surface of the ring member 120; the RFID 122 is arranged in the recess 120*c* from inside of the ring. When constructed in this manner, the outer peripheral surface 120*a* function as a protective wall protecting the RFID 122. Accordingly, external contaminant, such as toner, is less likely to stick to the RFID 122, allowing the antenna 124 to read information from the RFID 122 more reliably.

Figure 14:
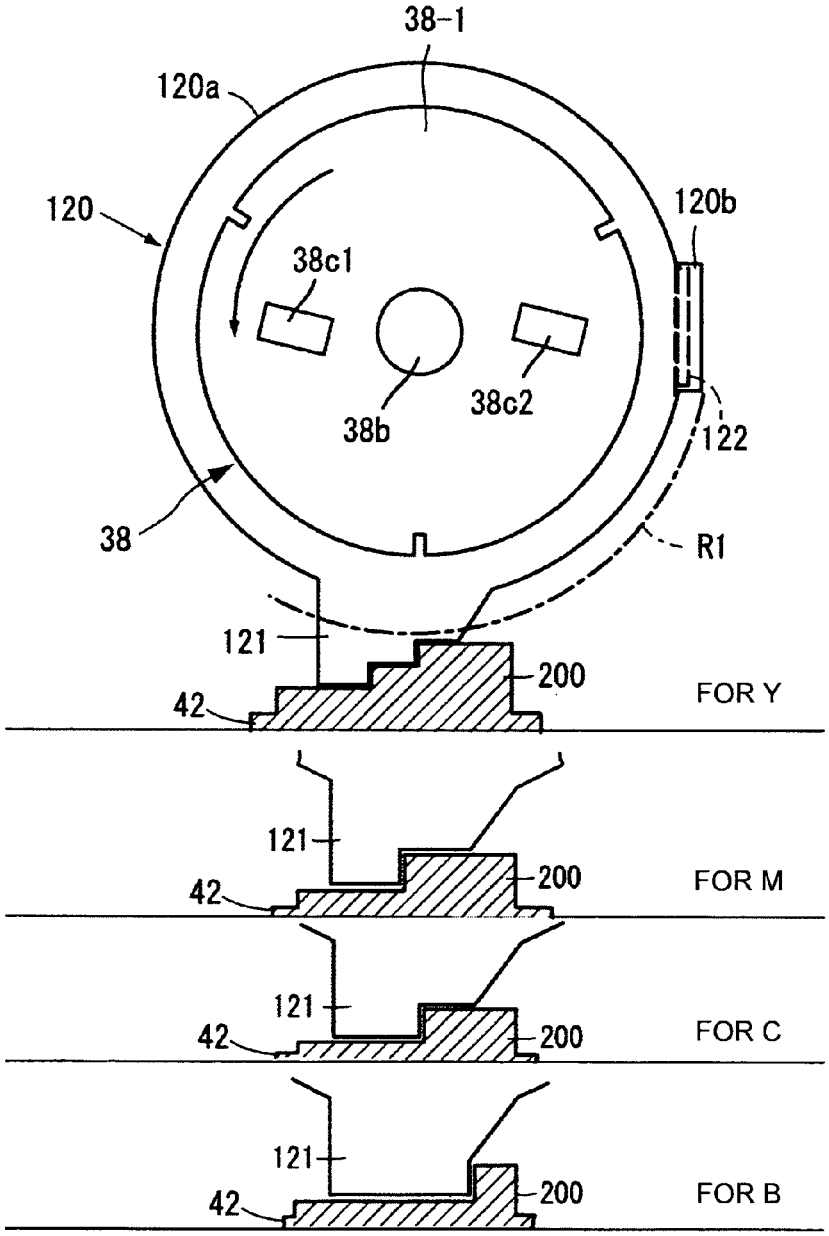
FIG. 14 is a schematic enlarged view illustrating a function of establishing non-interchangeability in terms of color or model provided by changing shapes of positioning members.

The positioning member 121 can be configured to perform a function of establishing non-interchangeability in terms of color or model of the toner container 38. An example is illustrated in FIG. 14. Referring to FIG. 14, the shapes of the positioning members 121 differ from one another on a per toner-color basis; the shapes of the stoppers 200 provided on the image-forming-apparatus main body 100 side conform to the shapes of the positioning members 121 for each color.

This configuration disables mounting of the toner container 38 on the toner cradle 42 of the toner supply device 160 unless otherwise the shape of the positioning member 121 of the ring member 120 mounted on the toner container 38 fits the shape of the stopper 200, which depends on the color of the toner in the toner container 38. This configuration also allows easy determination as to whether the toner container 38 has been mistakenly loaded by simple visual observation. Hence, the function of establishing non-interchangeability in terms of color or model can be provided based on the variation in the shape of the positioning member 121.

This configuration can be implemented by changing the shapes of the positioning members 121 on a color-by-color basis. Accordingly, by producing the positioning members 121 in different shapes on a per toner-color basis in production of the ring member 120, reduction in the number of components and simplified production process can be achieved.

Figure 15:
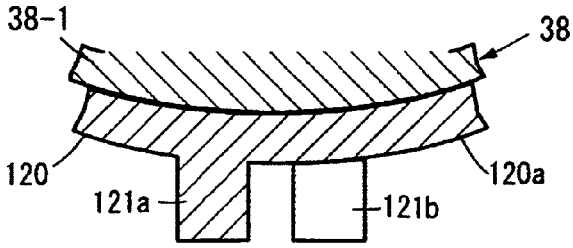
FIG. 15 is a schematic enlarged view illustrating the function of establishing non-interchangeability in terms of color or model provided by changing the number of the positioning members.

Regarding the arrangement of the positioning members 121, for example, as illustrated in FIG. 15, a plurality of positioning members 121*a* and 121*b* are arranged along the rotary direction of the toner container 38 and apart from each other in the axial direction of the container. By changing the clearance between (i.e., the positions of) the positioning members 121*a* and 121*b* on a per toner-color basis, color non-interchangeability can be established. By increasing the number of the positioning members 121*a* and 121*b* to three or greater, the number of arrangement patterns is increased, which allows the model non-interchangeability to be additionally established.

When such a configuration is employed, the ring member 120 holding the RFID 122 or the positioning member 121 also performs the function of establishing non-interchangeability. This leads to reduction in the number of components. Furthermore, the ring member 120 can be shaped to perform its function as the ring member and, additionally, the function of establishing non-interchangeability. This leads to simplification of production method.

Figure 16:
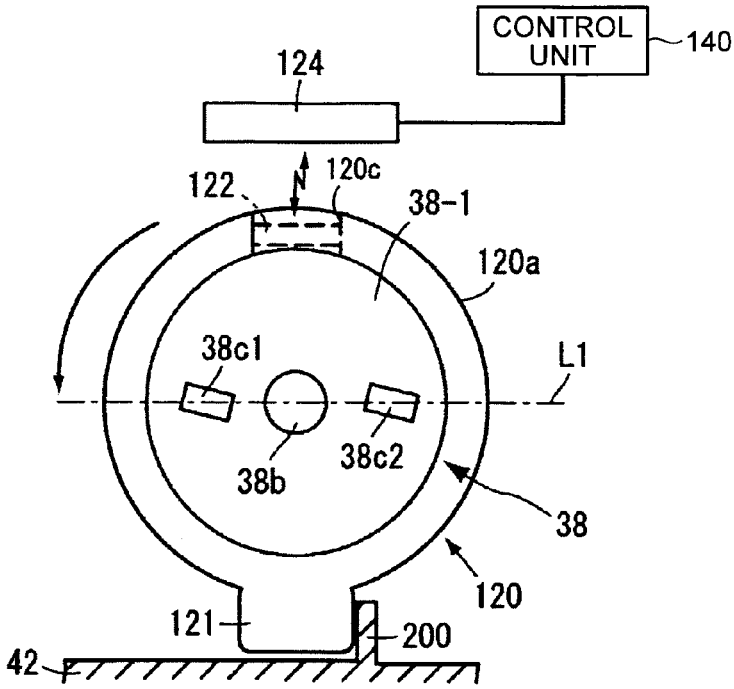
FIG. 16 is a schematic diagram illustrating a configuration where the information recording device is arranged above the powder container.

FIG. 16 illustrates a configuration where, when the toner container 38 is loaded on the toner cradle 42 of the toner supply device 160, on a cross-section taken along a plane perpendicular to a rotation axis of the container body 38-1 with the side, toward which the pull the gravity works, at the bottom, the toner container 38 is arranged such that, the RFID 122 is located on an outer periphery of the container body 38-1 at a position above a horizontal line L1 passing through the rotation axis. More specifically, the RFID 122 is positioned right above the toner container 38 when the toner container 38 is loaded on the toner cradle 42 and the positioning member 121 is rotated by the driving unit 60 (see FIG. 2) in the mounting direction and brought into contact with the stopper 200. Put another way, the RFID 122 is arranged in a space above the toner container 38. In this configuration, the antenna 124 is arranged at a position above the RFID 122 so as to face the RFID 122 at the mounted position.

This configuration allows the RFID 122 to be positioned and held in the space above the toner cradle 42 away from a lower portion of the toner cradle 42 of the toner container 38 where the RFID 122 is likely to be contaminated during mounting and removal of the toner container 38. Hence, influence resulting from toner sticking can be minimized. More specifically, when the toner container 38 is mounted on the toner cradle 42 of the toner supply device 160, the RFID 122 is constantly positioned above the horizontal line that virtually divides the ring member 120. This makes this configuration considerably advantageous in the context that contamination by toner sticking or the like is prevented. Accordingly, information communications can be carried out more reliably.

Figure 17:
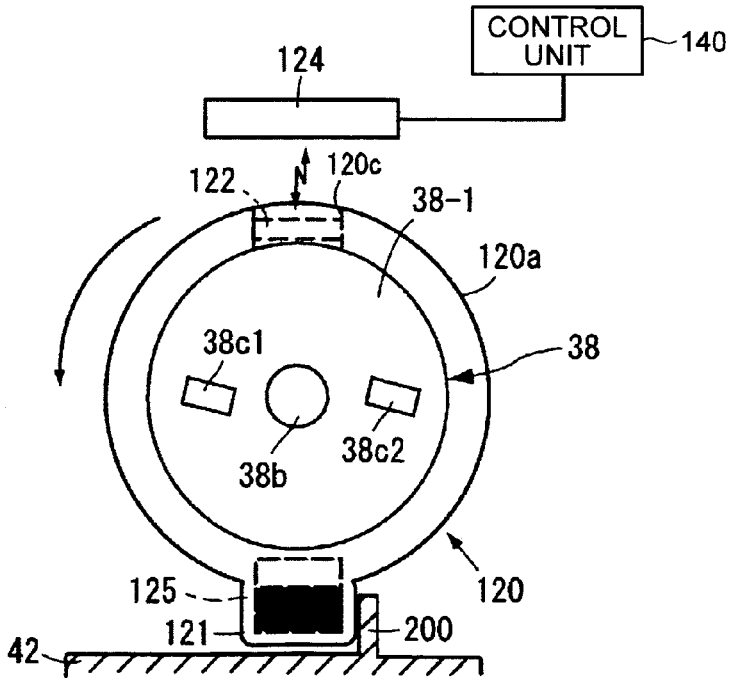
FIG. 17 is a schematic diagram illustrating a configuration where a weight is provided in the retainer to adjust center of gravity for improvement of stability.

FIG. 17 illustrates a configuration for improving stability of the toner supply device 160 loaded on the toner cradle 42 by using weight of the positioning member 121. In this configuration, a weight 125 is mounted on the positioning member 121.

When the positioning member 121 is provided at a position facing the RFID 122 and the positioning member 121 has a certain weight, as a matter of course, the ring member 120 is rotated relative to the container body 38-1 by the gravity, bringing the positioning member 121 to a lowermost position. Hence, the RFID 122 is brought to the uppermost position. When the antenna 124 is arranged at a position facing the RFID 122 when the RFID 122 is at the uppermost position, information communications can be carried out more reliably. The weight 125 allows the RFID 122 to be moved to a desired position even before an operation of discharging toner from the toner container 38 is performed or even when the operation is not performed. In this example, the RFID 122 is configured to be located at the uppermost position; alternatively, the RFID 122 can be configured to be located at another position. In this configuration, the center of gravity of the ring member 120 is lowered by forming the positioning member 121 at the position facing the location of the RFID 122 and the providing weight 125 in the positioning member. Alternatively, the center of gravity can be changed by making the positioning member 121 from a material, of which density is greater than that of the ring member 120, rather than by using the weight 125.

FIGS. 18A to 22 illustrate a modification where a positioning member utilizes magnetic force.

Figure 18A:
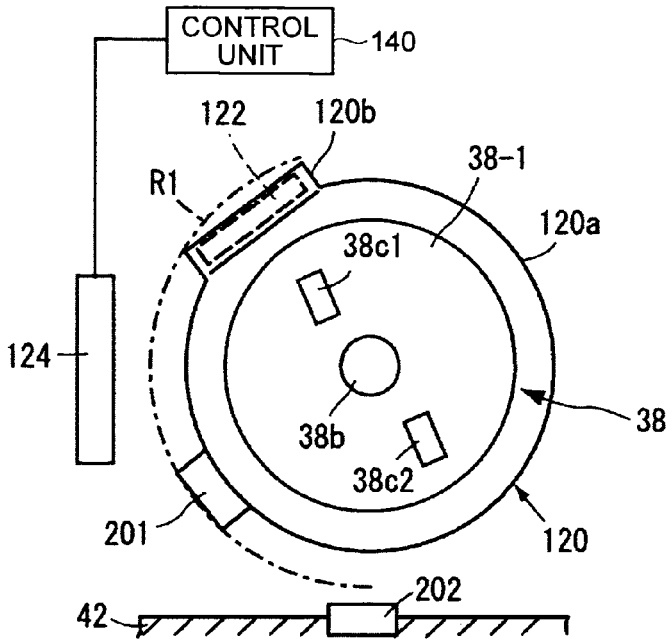
FIG. 18A is a schematic diagram illustrating the powder container including, as the positioning member, a magnet member and mounted on the image-forming-apparatus main body.
Figure 18B:
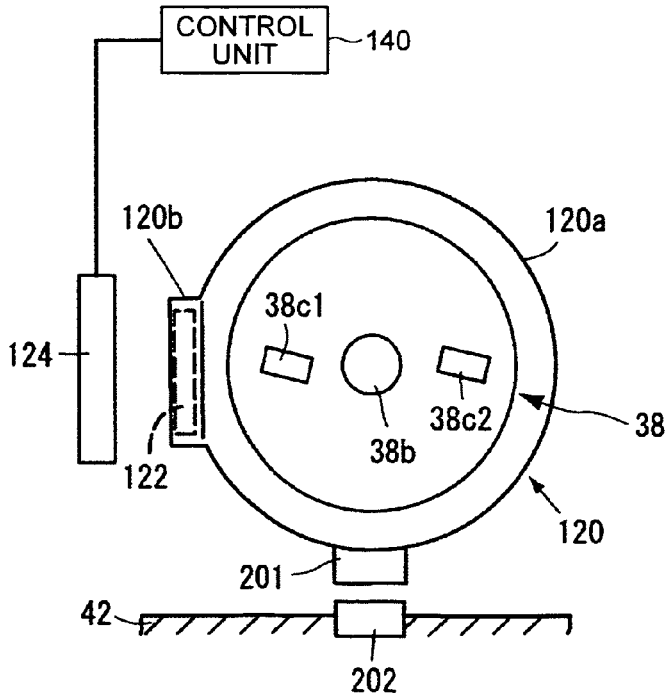
FIG. 18B is a diagram of the powder container rotated and positioned.
Figure 19:
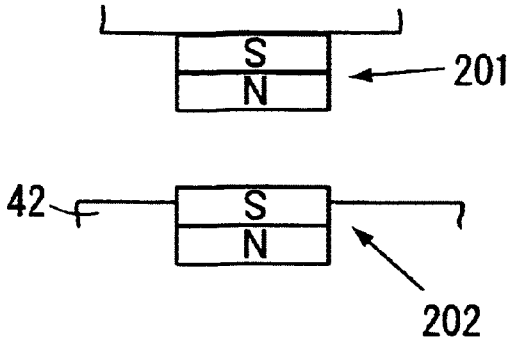
FIG. 19 is a schematic enlarged view illustrating relationship of magnetic poles between the magnetic member provided on the retainer and a magnetic member provided on the image-forming-apparatus main body.

A magnet 201, which is a magnetic member, is provided as a positioning member on the outer peripheral surface 120*a* of the ring member 120 illustrated in FIGS. 18A and 18B. The magnet 201 protrudes outward from the outer peripheral surface 120*a* of the ring. In this modification, the protruding length of the magnet 201 is determined such that the magnet 201 is located outside the movement path R1 of the receptacle 120*b*; alternatively, the magnet 201 can be located inside the movement path R1. A magnet 202, which is a magnet member serving as a receiving member, is provided on the toner cradle 42 of the toner supply device 160, which is on the image-forming-apparatus main body 100 side. The magnet 201 and the magnet 202 are arranged relative to each other in this way: when rotation of the ring member 120 is stopped by magnetic attraction between the magnet 201 and the magnet 202, the RFID 122 is located at the position where the RFID 122 faces the antenna 124. As illustrated FIG. 19, the magnet 201 and the magnet 202 are arranged such that magnetic poles on surfaces facing each other of the magnet 201 and the magnet 202 are opposite from each other.

In the arrangement illustrated in FIGS. 18A and 18B, the magnet 201 protrudes from the outer peripheral surface 120*a* of the ring member 120. Alternatively, a recess similar to the recess 120*c* illustrated in FIGS. 13B and 13C can be defined in the outer peripheral surface 120*a* or the inner circumferential surface of the ring member 120 to arrange the magnet 201 in the recess. The magnet 202 can be arranged not to protrude out of the toner cradle 42 of the toner supply device 160 in contrast to the arrangement where the magnet 202 protrudes from the image-forming-apparatus main body 100 toward the toner container 38.

As discussed above, the magnet 201 is arranged as the positioning member on the ring member 120 attached to the toner container 38 while the magnet 202 is arranged on the toner cradle 42, on which the toner container 38 is to be loaded, of the toner supply device 160. With this arrangement, loading the toner container 38 on the toner cradle 42 (the image-forming-apparatus main body 100) of the toner supply device 160 causes the ring member 120 that holds the RFID 122, which is rotatable relative to the container body 38-1, to include the magnet 201 that serves as the positioning member in positioning to the image-forming-apparatus main body. Hence, even when the toner container 38 is loaded on the toner cradle 42 of the toner supply device 160 without performing positioning of the toner container 38, when the container body 38-1 having been loaded is rotated by the driving unit 60 illustrated in FIGS. 3, 5, and 6 in the mounting direction, the ring member 120 is also rotated together with the container body 38-1 by friction drag. When the magnet 201 reaches the position where the magnet 201 faces the magnet 202, the ring member 120 is prevented from further rotating; however, the container body 38-1 is rotated to a predetermined position where toner can be discharged. Rotation of the container body 38-1 is stopped when the driving unit 60 is stopped. This not only facilitates positioning of the RFID 122 to the position where communications with the antenna 124 can be carried out but also allows the antenna 124 to read information from the RFID 122 reliably.

Put another way, a position of the RFID 122 can be detected by using the magnet 201 and the magnet 202. This allows a user to insert the toner container 38 into the image-forming-apparatus main body side with no consideration of orientation and the like and also allows the RFID 122 to be moved to a position where the RFID 122 can exchange necessary information according to toner discharging operation performed by the toner container 38. Hence, information exchange with the RFID 122 can be carried out without fail irrespective of the toner-discharging operation performed by the toner container 38 while experiencing substantially no influence of toner sticking. When the positioning member is configured to utilize the magnetic force of the magnet, which is the magnetic member, noise resulting from abutment is not produced. Accordingly, this configuration is advantageous as compared to a positioning unit including the positioning member 121 and the stopper 200 in the context of silent operation.

Figure 20:
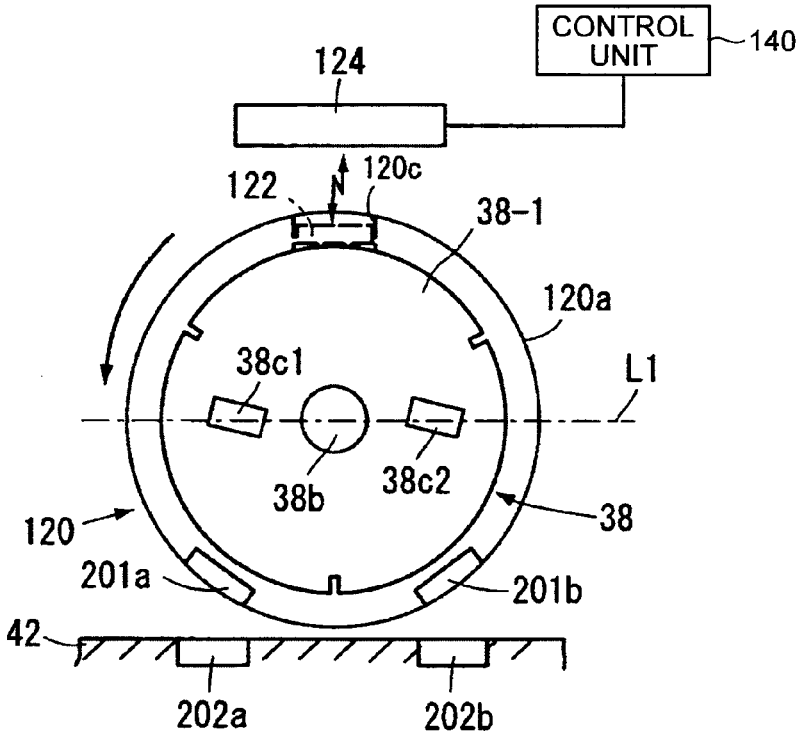
FIG. 20 is a schematic diagram a configuration where a plurality of magnetic members are used as the positioning member.

FIG. 20 illustrates a configuration where magnets 201*a* and 201*b* serving as a plurality of positioning members are arranged spaced from each other on the ring member 120 along a moving direction of the ring member and magnets 202*a* and 202*b* serving as receiving members of the magnets 201*a* and 201*b* are arranged on the toner cradle 42 (the image-forming-apparatus main body side) of the toner supply device 160. As illustrated FIG. 21, the magnets 201*a* and 201*b* and the magnets 202*a* and 202*b* are arranged such that magnetic poles on facing surfaces of the magnets 201*a* and 201*b* are opposite from each other and those of the magnets 202*a* and 202*b* are opposite from each other.

When a plurality of pairs of magnets for use in positioning are arranged in this manner, the magnetic force, or, put another way, a braking force for stopping rotation of the ring member 120 can be increased as compared to an arrangement including a pair of magnets. This allows the ring member 120 to be fixed stably to the position where information is to be exchanged between the RFID 122 and the antenna 124 even when the weight of the toner container 38 is large and therefore an inertial force produced by stoppage of rotation of the toner container 38 is large, or when the rotation speed of the toner container 38 being driven is high. Hence, this configuration substantially negates influence that would otherwise be exerted by toner sticking. Furthermore, the antenna 124 can read information from the RFID 122 reliably.

Figure 21:
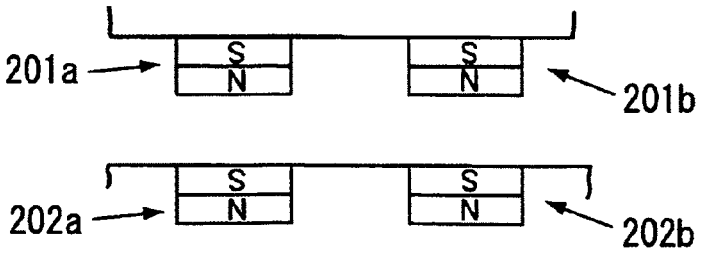
FIG. 21 is a schematic enlarged view illustrating relationship of magnetic poles between the magnetic members provided on the retainer and a plurality of magnetic members provided on the image-forming-apparatus main body.
Figure 22:
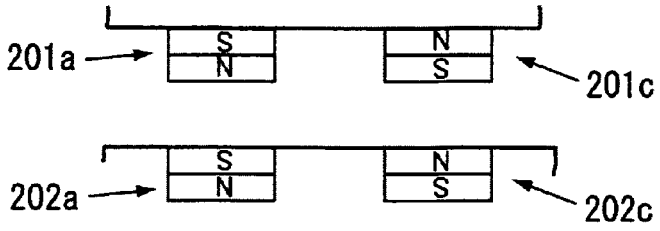
FIG. 22 is a schematic enlarged view illustrating diagonal relationship of magnetic poles between a plurality of magnetic members provided on the retainer and a plurality of magnetic members provided on the image-forming-apparatus main body.

In the example illustrated in FIG. 21, arrangement of magnetic poles of the magnets 201*a* and 201*b* and arrangement of magnetic poles of the magnets 202*a* and 202*b* are identical to each other. Alternatively, as illustrated in FIG. 22, a magnet 201*c* of which magnetic pole arrangement is opposite from that of the magnet 201*a* or a magnet 202*c* of which magnetic pole arrangement is opposite from that of the magnet 202*a* can be provided. More specifically, in this alternative construction, of the magnet 201*a* and the magnet 202*c* arranged to diagonally face each other, magnetic poles of same polarity face each other while, of the magnet 201*c* and the magnet 202*a* arranged to diagonally face each other, magnetic poles of same polarity face each other.

When such a configuration as discussed above is employed, unintended positioning that would otherwise occur due to attraction between magnets when a plurality of pairs of magnets are arranged can be prevented. For instance, in the configuration illustrated in FIG. 21, magnetic poles on the facing surfaces of the magnet 201*a* and the magnet 202*b* that are diagonally arranged are opposite in polarity. When magnetic attraction is exerted between the magnet 201*a* and the magnet 202*b*, the stop position of the ring member 120 can deviate from an intended position. In contrast, in the configuration where, as illustrated in FIG. 22, the magnetic poles on the facing surfaces of the magnet 201*a* and the magnet 202*c* are of the same polarity while the magnetic poles on the opposing surfaces of the magnet 201*c* and the magnet 202*a* are of the same polarity, magnetic attraction is not produced between the diagonally-arranged magnetic poles. Accordingly, the ring member 120 can be stopped at the position intended in design without fail.

Figure 23A:
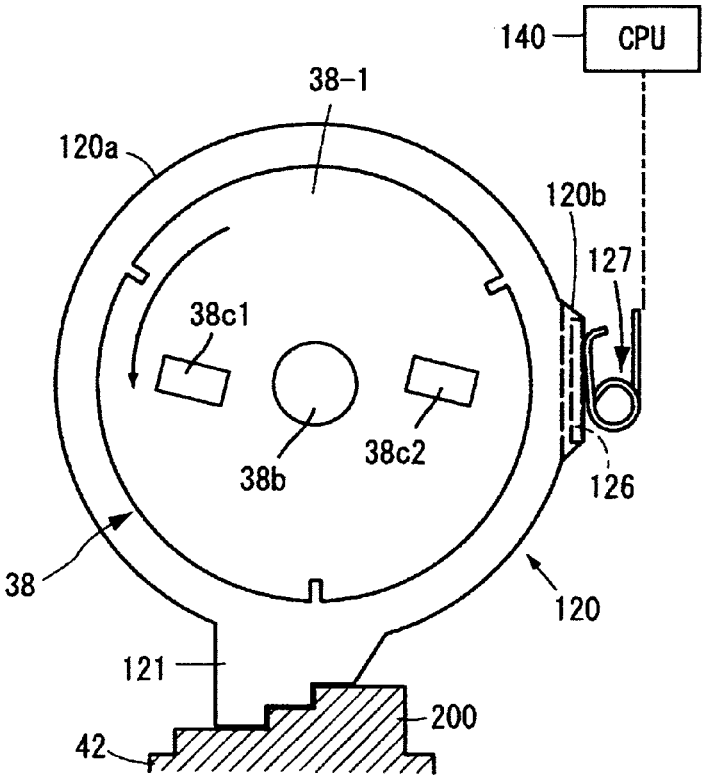
FIG. 23A is a schematic diagram illustrating the configuration of the powder container including the retainer including a contact information recording device in a state of being mounted and positioned on the image-forming-apparatus main body.
Figure 23B:
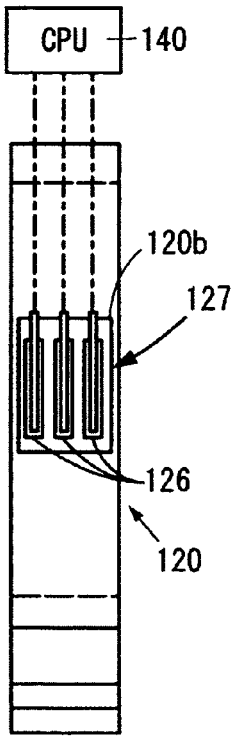
FIG. 23B is a schematic diagram illustrating the contact information recording device and an information communication unit in a contacting state.
Figure 24:
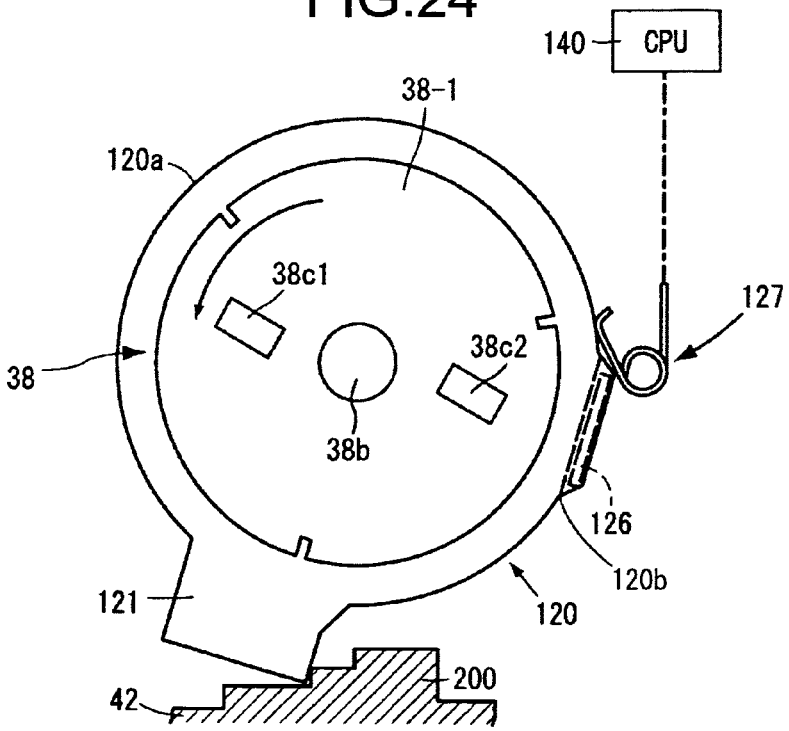
FIG. 24 is a schematic enlarged view illustrating the function of establishing non-interchangeability in terms of color or model of the powder container including the retainer that includes the contact information recording device.

In the embodiment discussed above, the contactless RFID 122 is employed as the information recording device; however, the information recording device is not limited to a contactless-type device. For instance, as illustrated in FIGS. 23A to 24, another configuration where, in lieu of the RFID 122 of each modification, a contact information recording device 126 is arranged in the receptacle 120*b* and a contact terminal 127 is arranged on the image-forming-apparatus main body side can be employed. When the ring member 120 is stopped by the positioning member 121 and the stopper 200, the contact information recording device 126 is brought into contact with the contact terminal 127 to carry out communications. The contact terminal 127 is connected to the control unit 140. The distal end of the contact terminal 127 is formed like a torsion coil spring so that the distal end contacts the outer peripheral surface 120*a* of the ring member 120 with an appropriate contact pressure. This causes the contact terminal 127 to resiliently contact the contact information recording device 126, thereby accommodating variations in mounting accuracy even when accuracy in mounting of the information recording device 126 varies.

Also in such a configuration as discussed above where the contact information recording device 126 is mounted on the ring member 120, as illustrated in FIG. 24, the positioning members 121 can be formed in different shapes on a per toner-color basis. This causes, even when an attempt of mounting the toner container 38 containing wrong-color toner on the toner cradle 42 of the toner supply device 160 is made, the shape of the positioning member 121 not to conform to the shape of the stopper 200. Accordingly, the ring member 120 is stopped at a position where the contact information recording device 126 is out of contact with the contact terminal 127, allowing the control unit 140 to determine that improper loading is performed.

In the configuration discussed above, the contact information recording device 126 is formed with the contact terminal 127 having resiliency; however, contact with the information recording device 126 can be made by using an elastic member, such as a leaf spring. When an additional component, such as a leaf spring, is employed, the additional component, such as the leaf spring, can be provided on any one of the toner cradle 42 of the toner supply device 160, which is the image-forming-apparatus main body side, and the toner container 38 side. Positioning of the information recording device 126 can be performed based on contact resistance between the information recording device 126 and the contact terminal 127 by adjusting elastic force of the contact terminal 127. This eliminates the need of providing the positioning member 121 and the magnets, causing the information recording device 126 and the contact terminal 127 to serve as positioning member, thereby simplifying structure.

In the modification illustrated in FIGS. 18A to 22, for performing positioning by using magnetic force, the magnets 201, 201*a*, 201*b*, and 201*c* are directly mounted on the ring member 120. The modification can be configured to further include the positioning member 121. For instance, in lieu of the weight 125 illustrated in FIG. 17, the magnet 201 illustrated in FIGS. 18A and 18B can be mounted on the ring member 120 and the magnet 202 can be arranged upstream from the stopper 200 relative to the rotary direction of the ring member 120. This configuration allows combined use of positioning members of different forms. This is advantageous in that when rotation of the ring member 120 is to be stopped by bringing the positioning member 121 into contact with the stopper 200, attraction force between the magnet 201 and the magnet 202 acts to exert braking force on the rotation of the ring member 120 before abutment between the positioning member 121 and the stopper 200 occurs. Accordingly, it is allowed to stop the rotation of the ring member 120 without fail while simultaneously reducing noise caused by abutment between the positioning member 121 and the stopper 200.

Even provided with no information about frequency of usage by a user or a type of output image, the image forming apparatus illustrated in FIG. 1 desirably supplies a required amount of toner to each of the developing devices at required times for high quality images. Hence, when toner supply is performed by using the toner containers 38 discussed in the embodiment in the toner supply devices 160Y to 160K of a corresponding one of the toner colors, toner can be supplied reliably from the toner containers 38 to the developing devices of the corresponding colors. Accordingly, images of high quality can be obtained.

An embodiment of a toner container, which is a developer supply container including a cap, is described below.

Figure 25:
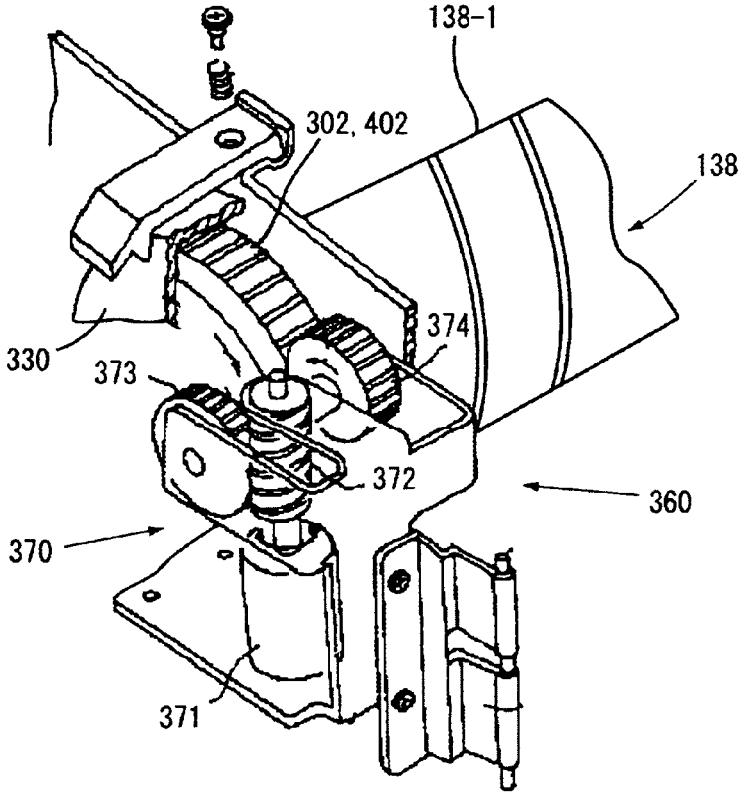
FIG. 25 is a schematic perspective view illustrating the configuration of a driving unit arranged in a powder container on a side near to the discharge port.
Figure 26:
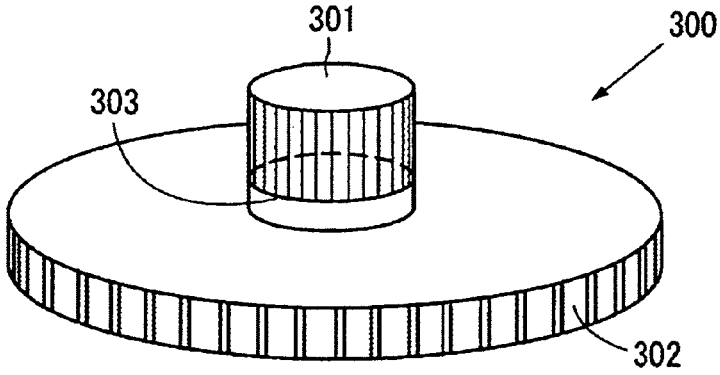
FIG. 26 is a schematic enlarged view illustrating a cap according to an embodiment of the present invention.
Figure 27:
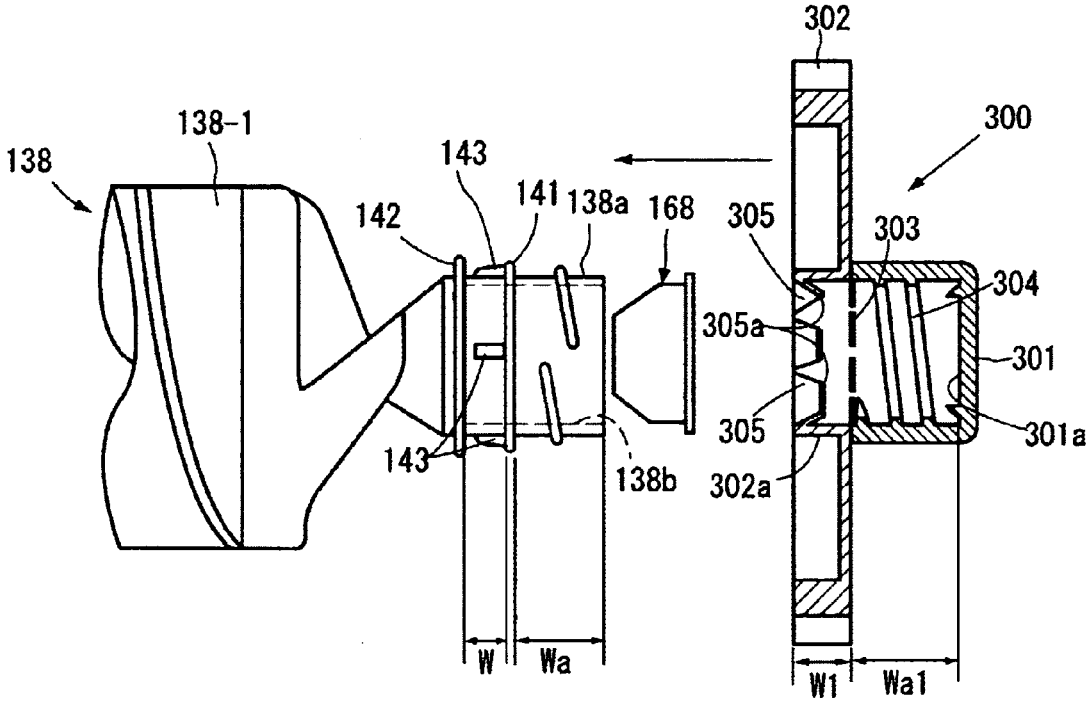
FIG. 27 is a schematic diagram illustrating the configuration of a bayonet base of the powder container and the cap not attached to the container yet.

A cap 300 illustrated in FIG. 26 is configured to be mounted on a toner container 138 illustrated in FIG. 27. As does the toner container 38, the toner container 138 includes a container body, which is a cylindrical large-diameter portion, a bayonet base 138*a*, which has a tapered cylindrical shape, and an intermediate portion, which is an intermediate diameter portion, interposed between the container body and the bayonet base 138*a* to connect therebetween. As illustrated in FIG. 25, a cover member 330 is placed outside the intermediate portion. The cover member 330 rotatably supports a container body 138-1. As illustrated in FIG. 27, a helical groove similar to a helical groove (not illustrated) defined in the toner container 138 is defined in the container body 138-1. When the container body 138-1 is rotated, developer in the container body 138-1 is conveyed through the helical groove toward a discharge port 138*b* defined in the bayonet base 138*a*.

As illustrated in FIGS. 26 and 27, the cap 300 includes a first attaching member and a second attaching member that are detachably assembled into one piece. In the present embodiment, the first attaching member includes an outer cap 301 that corresponds to a main body that opens/seals the discharge port 138*b*, whereas the second attaching member includes a gear 302 that corresponds to a drive transmission member detachably attached to the outer cap 301.

As illustrated in FIG. 27, the outer cap 301 has a closed-end cylindrical shape. A helical groove 304 that is to engage with a helical protrusion 139 formed on an outer peripheral surface of the bayonet base 138*a* is defined in an inner surface of the outer cap 301. By being screwed onto the bayonet base 138*a*, the outer cap 301 is mounted on the container body 138-1 to thereby seal the discharge port 138*b*, whereas by being removed from the bayonet base 138*a*, the outer cap 301 opens the discharge port 138*b*. In the present embodiment, an inner cap 168 is attached to inside of the bayonet base 138*a*. This inner cap 168 is pulled out of the discharge port 138*b* by the collet chuck 70 when the toner container 138 is mounted on a developer supply device 360, which will be described later, thereby allowing the developer (toner) in the container body 138-1 to be discharged to the outside. The collet chuck 70 having the same function as that of the collet chuck 70 illustrated in FIG. 3 is provided in the developer supply device 360.

The configuration of the developer supply device 360 is basically same as the configuration of the toner supply device 160 except for the configuration of a driving source. In the developer supply device 360, the driving source is configured to transmit rotary force to the gear 302, or a gear 402, corresponding to drive transmission member, attached to the bayonet base 138*a* of the toner container 138 rather than to move a rear-end portion of the toner container 138. Put another way, when the toner container 138 is mounted on the developer supply device 360, the developer supply device 360 can be rotated by the driving source illustrated in FIG. 25. As the configuration of the driving source, a configuration similar to that illustrated in FIG. 5 of Japanese Patent Application Laid-open No. H09-6115 can be employed. More specifically, a driving source 370 is configured in this way: a worm wheel 372 is attached to a shaft of a drive motor 371; the worm wheel 372 meshes with an intermediate gear 373; a driving gear 374 attached to the same shaft as that of the intermediate gear 373 meshes with the gear 302 of the toner container 138. The driving gear 374 to be rotated by the drive motor 371 meshes with the gear 302 when the toner container 138 is loaded on the developer supply device 360, thereby transmitting rotary drive force to the gear 302.

The outer cap 301 and the gear 302 are made of POM exhibiting excellent durability and detachably assembled into one piece with a releasing unit 303, in which a plurality of slits are defined. In the present embodiment, the outer cap 301 and the gear 302 are assembled into one piece with the releasing unit 303; alternatively, the outer cap 301 and the gear 302 can be assembled into one piece with an adhesive tape having slits in a dotted line. In this case, the outer cap 301 and the gear 302 can be made of different materials such that, for instance, the outer cap 301 and the gear 302 are made of PET and POM, respectively. Accordingly, durability appropriate for function can be ensured.

An annular protrusion 141 and a collar 142 are formed on outer periphery of the bayonet base 138*a*, to which the cap 300 is to be attached, at portions nearer to the container body 138-1 than the helical protrusion 139 is. A clearance W between the annular protrusion 141 and the helical protrusion 139 is greater than a width W1, taken in an axial direction, of the gear 302 by a certain length. A length Wa between an end surface of the bayonet base 138*a* and the annular protrusion 141 and a depth Wa1 of the outer cap 301 are determined such that when the cap 300 is attached to the bayonet base 138*a*, the gear 302 is placed in a space between the annular protrusion 141 and the collar 142 and simultaneously a bottom portion 301*a* of the outer cap 301 is brought into close contact with the end surface of the bayonet base 138*a* to thereby seal the discharge port 138*b*. In the present embodiment, the inner cap 168 is inserted into the discharge port 138*b*. Accordingly, the bottom portion 301*a* holds down a flange portion 168*a* of the inner cap 168.

Each of a protruding length in the radial direction of the annular protrusion 141 and a protruding length in the radial direction of the collar 142 is greater than a diameter of a boss 302*a* of the gear 302. Accordingly, the configuration where the gear 302 is interposed between the annular protrusion 141 and the collar 142 causes the annular protrusion 141 and the collar 142 to function as a positional member in the axial direction. The radial protruding length of the annular protrusion 141 formed on the side near to the helical protrusion 139 is smaller than the radial protruding length of the collar 142 located on the side near to the container body 138-1. This increases operability in mounting/releasing.

A plurality of claws 305 are formed inside the boss 302*a* of the gear 302 in a circular arrangement whose diameter is smaller than the diameter of the annular protrusion 141. Each of the claws 305 is formed by bending an end surface of the boss 302*a* and partially defining notches in the end surface along the circumferential direction. The claw 305 is elastically deformable in the radial direction. In the present embodiment, the thus-bent portion of the claw 305 is positioned on the side opposite from the outer cap 301, or, put another way, on the side near to the bayonet base 138*a*.

Figure 28:
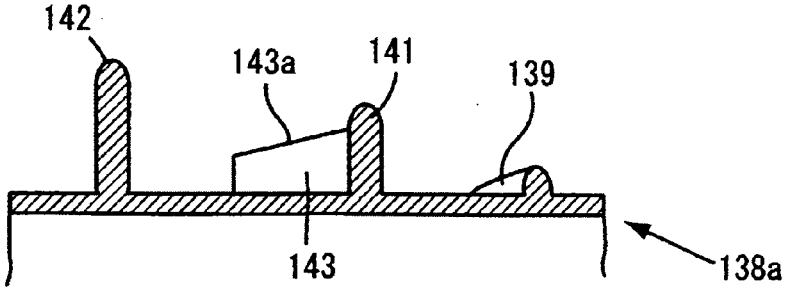
FIG. 28 is a schematic cross-sectional view illustrating the configuration of the bayonet base of the powder container.
Figure 29:
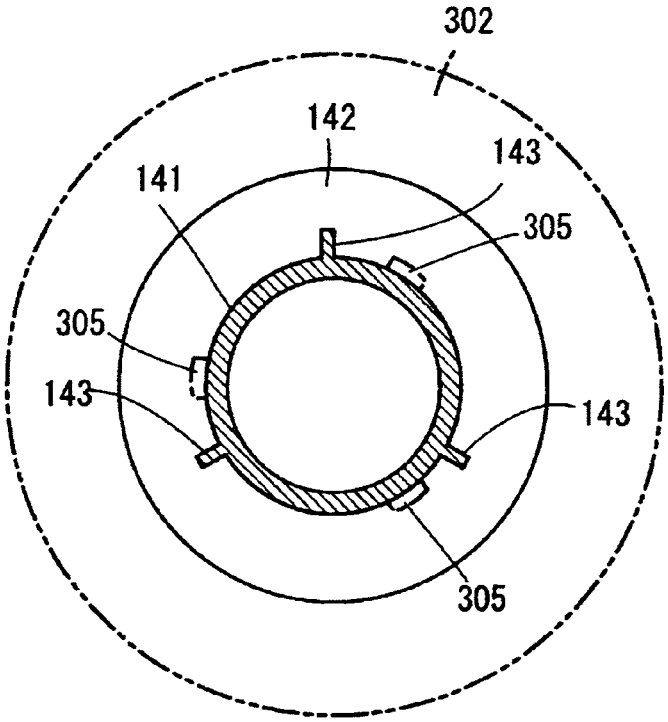
FIG. 29 is a schematic enlarged diagram illustrating relationship between claws and protrusions.

As illustrated in FIGS. 27 and 28, at least one protrusion 143 serving as a rotation stopper is formed on the outer peripheral surface of the bayonet base 138*a* positioned between the annular protrusion 141 and the collar 142. The protrusion 143 extends from the annular protrusion 141 and includes an outer surface 143*a*, which is a slope whose height degreases from the annular protrusion 141 to the collar 142. In the present embodiment, as illustrated in FIG. 29, the number of the protrusions 143 is greater than two; the plurality of protrusions 143 are arranged between the annular protrusion 141 and the collar 142 in the circumferential direction such that the protrusions 143 are spaced from one another. The spacing between the protrusions 143 is greater than a width of the claws 305 in the circumferential direction. The height of the protrusions 143 is set to such a value that hampers the claws 305 from climbing over the protrusions 143 when a rotary force is transmitted to the gear 302, which in turn rotates the toner container 138.

Figure 30:
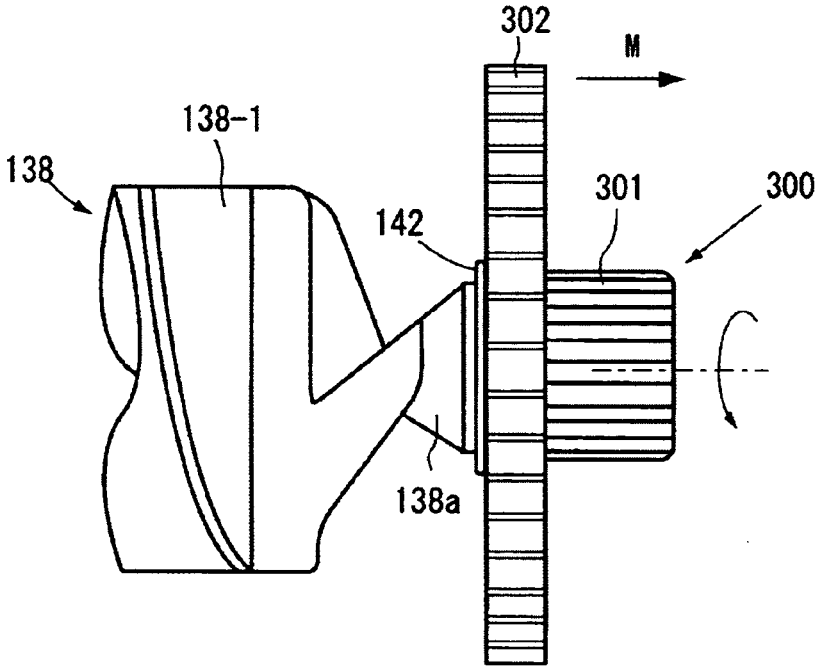
FIG. 30 is a schematic enlarged view illustrating the bayonet base, to which the cap is attached, of the powder container.

To attach the cap 300 to the toner container 138 including the bayonet base 138*a* configured as discussed above, the outer cap 301 is screwed onto toner container 138 from the side facing the end surface of the bayonet base 138*a* in a state where the inner cap 168 is inserted into the discharge port 138*b*. When the claws 305 climb over the annular protrusion 141 during progress of the attaching operation, the claws 305 are elastically deformed in a direction of being folded inward. When the claws 305 have climbed over the annular protrusion 141, the gear 302 is positioned between the annular protrusion 141 and the collar 142. Simultaneously, when the claws 305 have climbed over the annular protrusion 141, the elastic deformation is reversed, causing the claws 305 to rise toward the center of the bayonet base 138*a* and engage with the annular protrusion 141. This engagement causes the annular protrusion 141 and the collar 142 to restrict movement of the gear 302 in the axial direction, or, in other words, in a releasing direction M, as illustrated in FIG. 30. Hence, the gear 302 is attached to the bayonet base 138*a* in a slip-off-prevented state; simultaneously, the discharge port 138*b* is sealed by the outer cap 301. This state where the cap 300 is attached to the toner container 138 is referred to a pre-shipment state where the discharge port 138*b* is in a sealed state.

Figure 31:
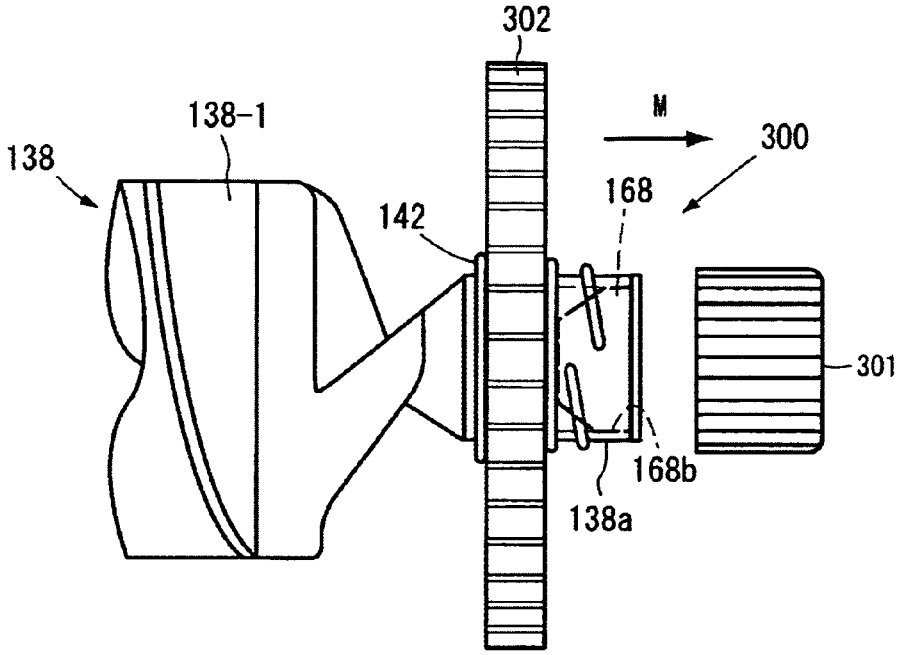
FIG. 31 is a schematic enlarged view illustrating the cap, from which an outer cap (main body) is removed, attached to the powder container.

To load the toner container 138 in the sealed state on the apparatus, an operator rotates the outer cap 301 in a removing direction. This causes the gear 302 to also move in the same direction as the outer cap 301 by a distance corresponding to a circumferential play of the claws 305 and the protrusions 143. However, when the claws 305 abut the protrusions 143 in the circumferential direction and engage therewith, movement of the gear 302 in the rotary direction is restricted. Meanwhile, the releasing unit 303 has relatively low strength in the circumferential direction because of the slits defined therein in the circumferential direction. Accordingly, rotating the outer cap 301 causes the outer cap 301 and the gear 302 to be separated from the releasing unit 303 as illustrated in FIG. 31. Hence, when the outer cap 301 is removed from the container body 138-1 to open the discharge port 138*b*, the gear 302 is separated from the outer cap 301 to be left on the container body 138-1 side. More specifically, when a rotary force (cap-opening force) is exerted by an operator, such as a user or a service person, on the outer cap 301, a force for rotating the gear 302, which is integral with the outer cap 301, is applied to the gear 302. However, the gear 302 is in a substantially fixed state where movement of the gear 302 in the rotary direction is restricted by the claws 305 and the protrusions 143. Accordingly, the gear 302 is separated from the outer cap 301 when the rotary force (cap-opening force) has exceeded a limit of the releasing unit 303.

Figure 32:
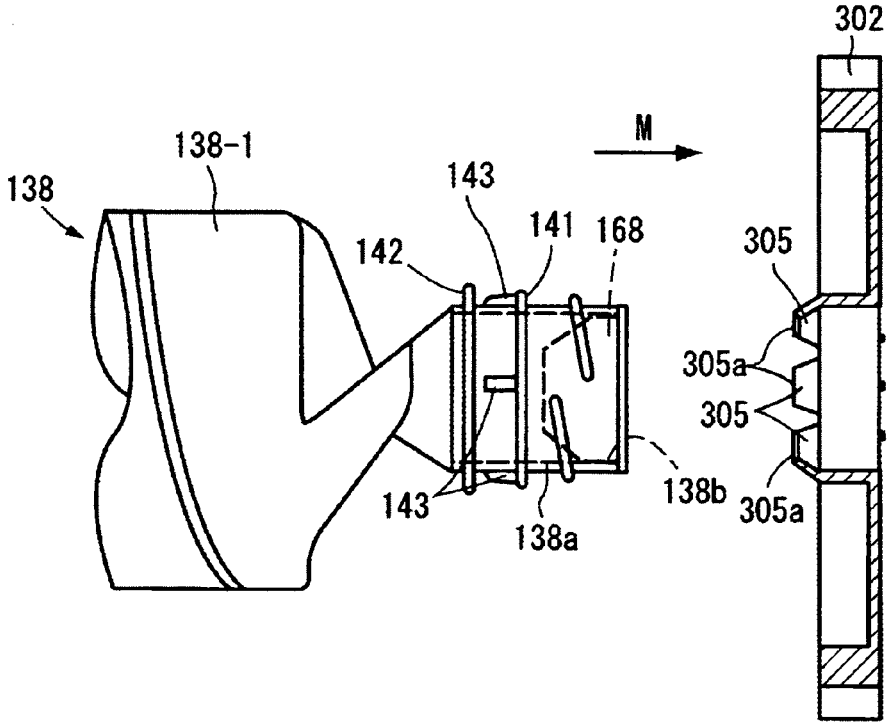
FIG. 32 is a schematic enlarged view illustrating the powder container, from which a drive transmission member having been fixed thereto is removed.

To remove the gear 302 from the toner container 138, being a used one, the gear 302 is pulled toward the annular protrusion 141, or, in the releasing direction M, as illustrated in FIG. 32. This causes leading ends 305*a* of the claws 305 to be caught by an inner side surface of the annular protrusion 141. When a load equal to or exceeding a predetermined load is applied on the gear 302 in the releasing direction M, the claws 305 having been bent are bent back while pivoting about contact portions between the leading ends 305*a* and the annular protrusion 141, causing the claws 305 to rise and climb over the annular protrusion 141 in the releasing direction M. Hence, the gear 302 is removed from the toner container 138.

As discussed above, the cap 300 including the outer cap 301 and the gear 302 that are detachably assembled into one piece is attached to the toner container 138. When a rotary force is applied onto the outer cap 301 in the attached state, the releasing unit 303 is broken, causing the outer cap 301 and the gear 302 to rotate relative to each other, thereby opening the discharge port 138*b*. Hence, assembly work of the cap 300 is facilitated and operability is improved.

This also allows an operator to determine whether the toner container 138 is a not-yet-opened toner container or an already-opened toner container by checking the state of the releasing unit 303, or, more specifically, by determining whether the outer cap 301 rotates. This allows determination as to whether the toner container 138 is a new one or an old one to be made at relatively low cost, easily, and with favorable operability. This allows determination as to whether the toner container 138 is an authorized product depending on whether the outer cap 301 rotates as well.

After removal of the gear 302, the cap 300, being a brand-new one, can be attached to the toner container 138. Hence, each of the toner container 138 and the gear 302 can be made from a material appropriate for its functional property. This negates a manufacture-related limitation, thereby enhancing product durability and achieving cost reduction. Furthermore, the gear 302 can be removed from the toner container 138, being a used one. This increases efficiency in cleaning of the toner container 138, thereby increasing a reuse ratio.

Figure 33A:
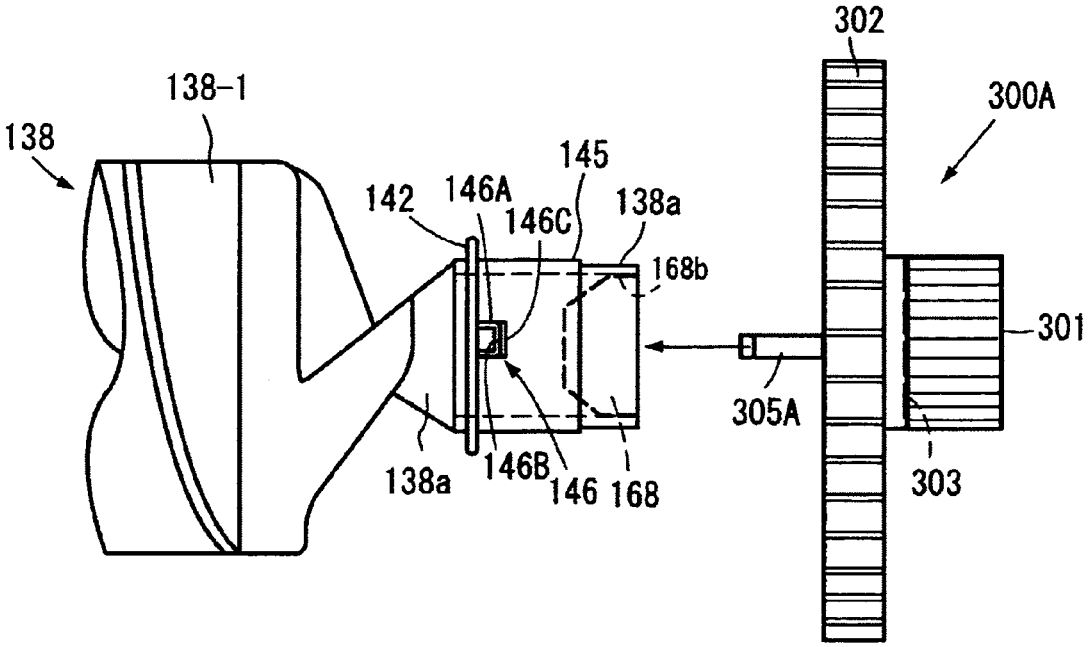
FIGS. 33A and 33B are schematic diagrams illustrating a modification of a bayonet base and a cap of the powder container.
Figure 33B:
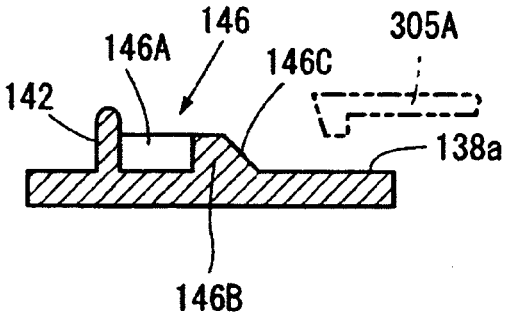

FIGS. 33A to 34B illustrate a modification of the bayonet base and the cap of the toner container 138. A cap 300A illustrated in FIGS. 33A and 33B is basically similar to the cap 300; in the cap 300A, the outer cap 301 and the gear 302 are detachably assembled into one piece with the releasing unit 303. However, the cap 300A differs from the cap 300 in that claws 305A axially extending from the gear 302 are formed on the gear 302 at diagonally-arranged two positions and that the shape of a protrusion 141A formed on the bayonet base 138*a* and serving as a slip-off preventing member differs from that of the equivalent.

The helical protrusion 139 is not defined in the bayonet base 138*a*. The collar 142, a stepped portion 145 formed on a circumferential surface between the collar 142 and the bayonet base 138*a*, and protrusions 146 are formed on the bayonet base 138*a*. The protrusions 146 are to individually engage with the claws 305A. The stepped portion 145 is a guide surface that guides the claws 305A when the cap 300A is rotated.

Each of the protrusions 146 extends from the bayonet base 138*a* in the longitudinal direction of the toner container 138 and includes a circumferential stopper 146A that extends outward than the stepped portion 145 to stop rotation of the claw 305A in a gear-rotating direction, a release restricting portion 146B that restricts movement in the releasing direction M of the claw 305A, and an inclined surface 146C formed on the release restricting portion 146B. The inclined surface 146C is an inclined surface of which height increases from the end surface of the bayonet base 138*a* to the collar 142. The inclined surface 146C serves as the guide surface that guides the claws 305A to the release restricting portion 146B so that the claws 305A can easily climb over the release restricting portion 146B during attaching of the cap 300A.

Figure 34A:
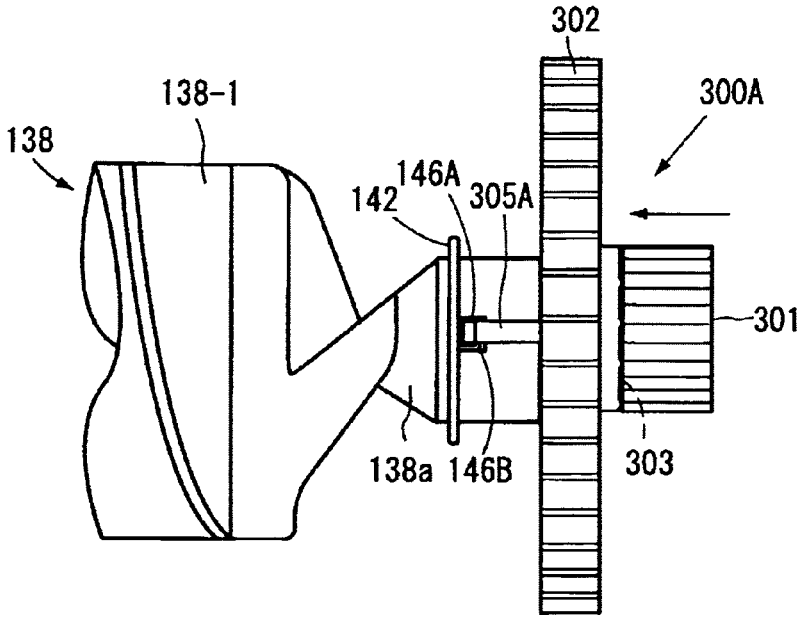
FIG. 34A is a schematic diagram illustrating the cap, from which the main body is removed, mounted on the powder container.
Figure 34B:
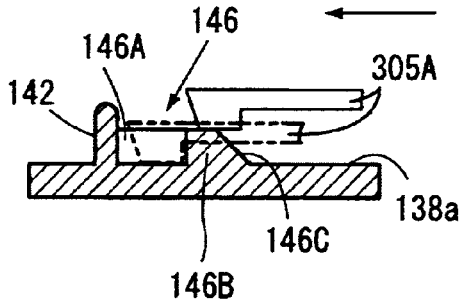
FIG. 34B is a schematic enlarged cross-sectional view illustrating the claw in an engaged state.

When the cap 300A configured as discussed above is attached to the bayonet base 138*a* and pressed thereinto, as illustrated in FIGS. 34A and 34B, the claws 305A climb over the release restricting portions 146B. This causes leading ends of the claws 305A to engage with the release restricting portions 146B, thereby restricting movement of the claws 305A in the releasing direction M of the claws 305A. The circumferential stoppers 146A restrict movement of the claws 305A in the circumferential direction. As a result, the discharge port 138*b* is sealed by the outer cap 301. This state where the cap 300A is attached to the toner container 138 is referred to a pre-shipment state where the discharge port 138*b* is in the sealed state.

To load the toner container 138 in the sealed state on the apparatus, an operator rotates the outer cap 301 in the removing direction, by which a rotary force (cap-opening force) is applied onto the outer cap 301. At this time, a force for rotating the gear 302 together with the outer cap 301 is applied to the gear 302; however, movement of the gear 302 in the rotary direction is restricted by the circumferential stoppers 146A. Accordingly, the gear 302 and the outer cap 301 are separated from the releasing unit 303. Hence, when the outer cap 301 is removed from the container body 138-1 to open the discharge port 138*b*, the gear 302 is separated from the outer cap 301 to be left on the container body 138-1 side. More specifically, when the rotary force (cap-opening force) applied by the operator to the outer cap 301 has exceeded a limit of the releasing unit 303, the gear 302 integral with the outer cap 301 is separated from the outer cap 301.

To remove the gear 302 from the toner container 138, being a used one, the gear 302 is rotated, as illustrated in FIG. 32, in the direction opposite from the driving direction. This releases the engagement between the circumferential stoppers 146A and the claws 305A and the engagement between the release restricting portions 146B and the claws 305A, allowing the claws 305A to move in the releasing direction M easily so that the gear 302 can be removed.

As discussed above, the cap 300A including the outer cap 301 and the gear 302 that are detachably assembled into one piece is attached to the toner container 138. When a rotary force is applied onto the outer cap 301 in the attached state, the releasing unit 303 is broken, causing the outer cap 301 and the gear 302 to rotate relative to each other, thereby opening the discharge port 138*b*. Hence, assembly work of the cap 300A is facilitated and operability is improved.

After removal of the gear 302, the cap 300A, being a brand-new one, can be attached to the toner container 138. Hence, each of the toner container 138 and the gear 302 can be made from a material appropriate for its functional property. This negates a manufacture-related limitation, thereby enhancing product durability and achieving cost reduction. Furthermore, the gear 302 can be removed from the toner container 138, being a used one. This increases efficiency in cleaning of the toner container 138, thereby increasing a reuse ratio.

In this modification, the protrusions 146 are formed on portions of the circumference of the bayonet base 138*a* so as to conform to the two claws 305A. However, in a situation where there are a number of factors, such as a backlash and an increase in the driving force transmitted to the gear 302, that impart loads on the gear 302 in the direction opposite to the rotating direction of the gear 302, the claws 305A can slip off from the protrusion 146.

Figure 35:
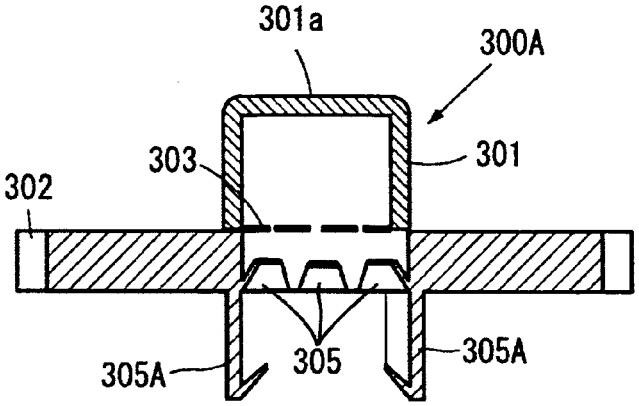
FIG. 35 is a schematic diagram illustrating a modification of the claws provided on the powder container.

For such a situation, as illustrated in FIG. 35, the claws 305 can be additionally formed on the boss 302*a* of the gear 302 and the annular protrusion 141 can also be additionally formed all around the circumference of the bayonet base 138*a* so that a plurality of pairs of the claws 305 and 305A and a plurality of pairs of the protrusions 141 and 146 prevent slip off of the gear 302.

Figure 36:
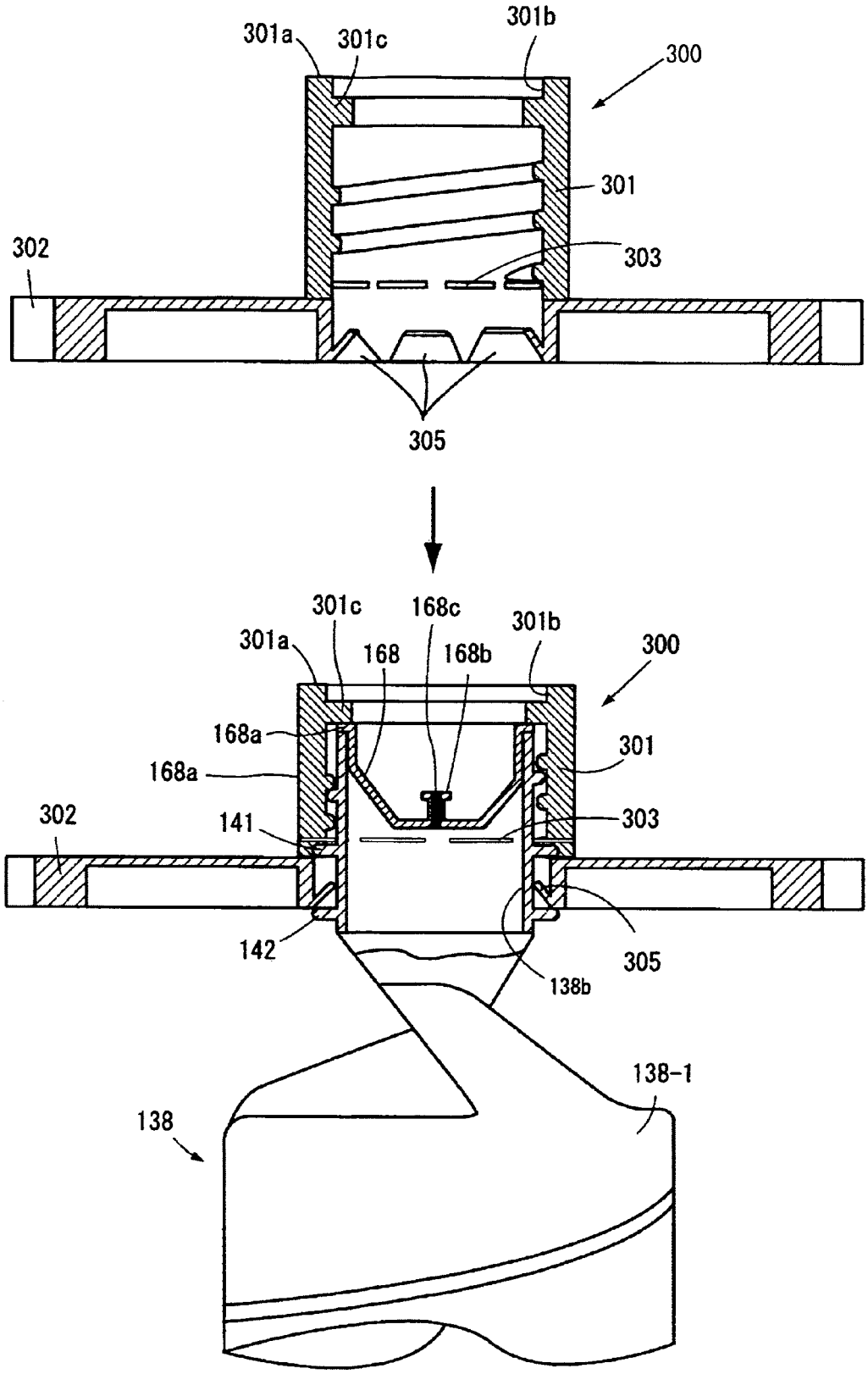
FIG. 36 is a schematic cross-sectional view illustrating the cap having openings in the main body and the powder container in an attached state.

FIG. 36 illustrates a configuration where an opening 301*b* is defined in the bottom portion 301*a* of the outer cap 301 of the cap 300. The inner cap 168 is depressed at its center portion toward the inside of the container. The inner cap 168 also has an opening 168*b* at the center portion. A filter 168*c* that has permeability but does not allow toner to pass therethrough is inserted into the opening 168*b* to prevent slip off of the inner cap 168 even when a change in barometric pressure has developed between inside and outside of the container. Permeability of the filter 168*c* is not impaired because the opening 301*b* is defined in the outer cap 301. The opening 301*b* is desirably of a size that allows insertion, into the opening 301*b*, of the collet chuck 70 (see FIG. 3) that grips and releases the inner cap 168. This allows the toner container 138 to be loaded on the apparatus without removing the outer cap 301; even in a state where rotary drive force is transmitted from the driving source to the gear 302, the outer cap 301 can be separated from the gear 302. By actuating the collet chuck 70 and pulling the inner cap 168 out of the discharge port 168*b*, the discharge port 138*b* can be opened easily. Accordingly, the toner container 138, from which toner is less likely to be squirted during transportation, can be provided.

Figure 37A:
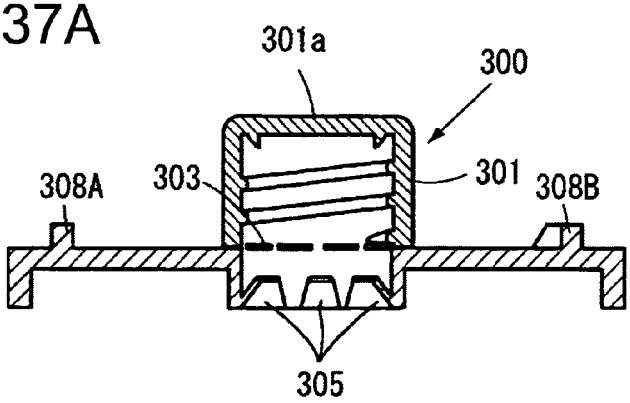
FIG. 37A is a schematic partially-enlarged cross-sectional view illustrating a modification of the drive transmission member.
Figure 37B:
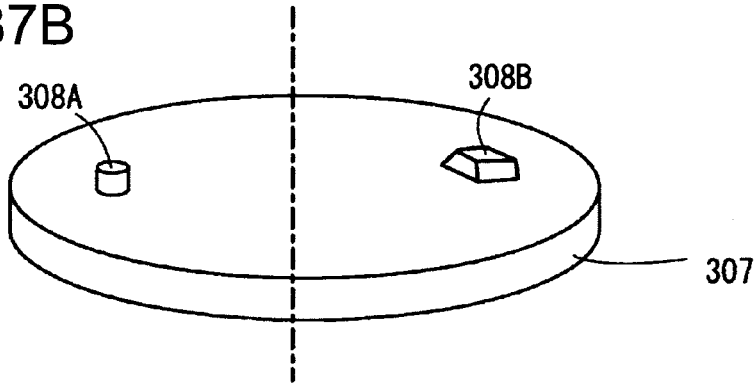
FIG. 37B is a schematic perspective view illustrating the configuration of the modification of the drive transmission member.
Figure 38A:
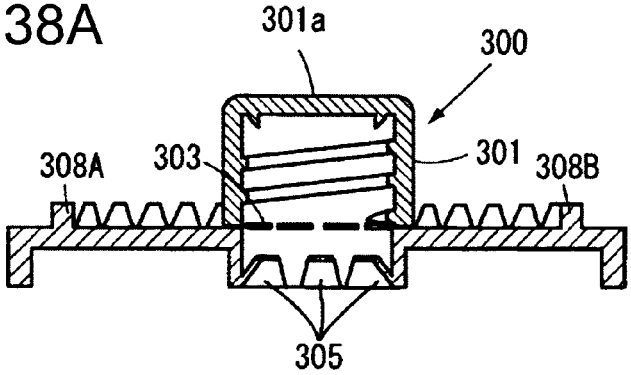
FIG. 38A is a schematic partially-enlarged cross-sectional view illustrating a modification of the drive transmission member.
Figure 38B:
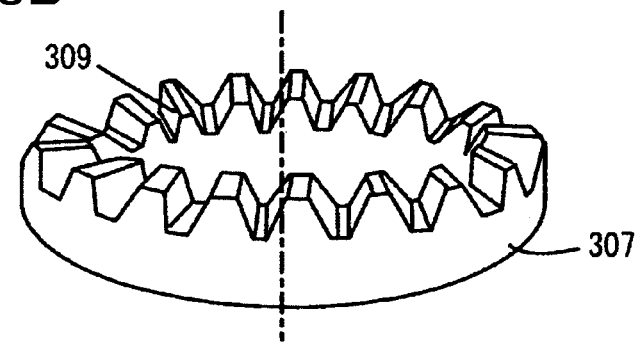
FIG. 38B is a schematic perspective view illustrating the configuration of the modification of the drive transmission member.
Figure 39:
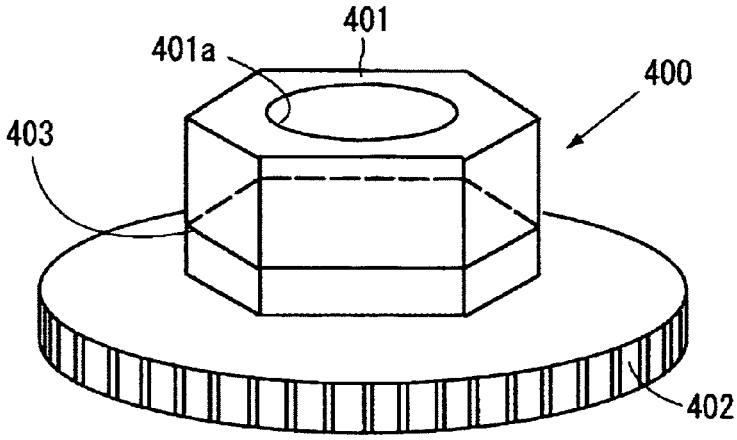
FIG. 39 is a schematic enlarged diagram illustrating the configuration of a cap including a fixing member.

In the modification discussed above, the gear (spur gear) 302 is used as the drive transmission member; however, the drive transmission member is not limited thereto. A modification of the drive transmission member can be, for instance, a plurality of protrusions 308A and 308B that axially protrude from a disk portion 307 as illustrated in FIGS. 37A and 37B. The disk portion 307 is detachably integral with the outer cap 301 with the releasing unit 303 therebetween. By transmitting rotary force to the protrusions 308A and 308B, the protrusions 308A and 308B can be employed as the drive transmission member. The protrusions 308 can be of the same shape or of different shapes. When a gear is to be used as the drive transmission member, the gear is not limited to the spur gear. For instance, as illustrated in FIGS. 38A and 38B, gears 309 axially protruding from the disk portion 307, which is detachably integral with the outer cap 301 with the releasing unit 303 therebetween, and arranged in a circular arrangement can be employed as the drive transmission member by transmitting rotary force to the gears 309.

Although the surface of the outer cap 301 can be a flat surface, the surface of the outer cap 301 preferably has an uneven portion, such as a knurled portion. This is because, when an operator loads the cap 300, 300A on the toner container 138, the uneven portion allows the operator to perform screwing of the cap 300, 300A into the toner container 138 and removal therefrom without experiencing slip.

A cap according to another embodiment is described below with reference to FIGS. 39 to 42B. A cap 400 illustrated in FIG. 39 includes a first attaching member and a second attaching member that are detachably assembled into one piece. When a rotary force (rotary drive force) is applied onto the first or second attaching member from the driving gear 374 illustrated in FIG. 25, the first and second attaching members are separated from each other. In the present embodiment, the first attaching member is a fixing member 401 that is to engage with the cover member 330 illustrated in FIGS. 42A and 42B that is to be attached to the container body 138-1. The second attaching member is the gear 402 serving as the drive transmission member that is detachably integral with the fixing member 401. On receiving the rotary force (rotary drive force), the gear 402 is separated from the fixing member 401 to be left on the container body 138-1 side. Basically, the cap 400 is also configured such that the fixing member 401 and the gear 402 are detachably assembled into one piece with a releasing unit 403. A hole 401*a* in communicative connection with the discharge port 168*b* is defined at the center of the fixing member 401 and the gear 402. The collet chuck 70 can be inserted into the hole 401*a* when the collet chuck 70 is actuated during mounting onto the apparatus. A retaining portion 401*b* that retains a flange portion 168*a* of the inner cap 168 during attaching of the cap 400 to the toner container 138 is formed around the hole 401*a*.

Figure 40:
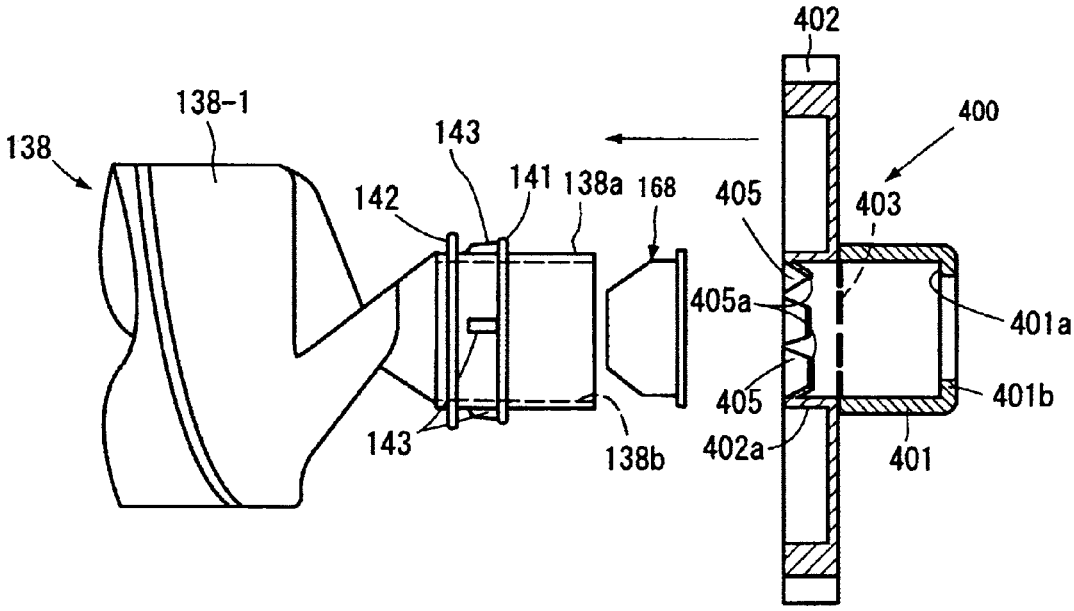
FIG. 40 is a schematic diagram illustrating the configuration of the bayonet base of the powder container and a not-mounted-yet state of the cap including the fixing member.

The cap 400 can be made of a material different from a material of the toner container 138. Accordingly, a material appropriate for transmitting power can be used. The toner container 138 is typically made of PET or PE, which is unfavorable for transmitting power. In particular, when the drive transmission member is made of PET or PE, the toner container 138 can be disadvantageously limited in the number of times the toner container 38 can be used. In this context, the gear 402 serving as the drive transmission member is typically made of POM or the like. When torque to be received is assumed to be high, the gear 402 can be made of metal. The same goes for the gear 302. The gear 402 is identical in configuration with the gear 302. As illustrated in FIG. 40, a plurality of claws 405 are formed on a boss 402*a*.

Figure 41:
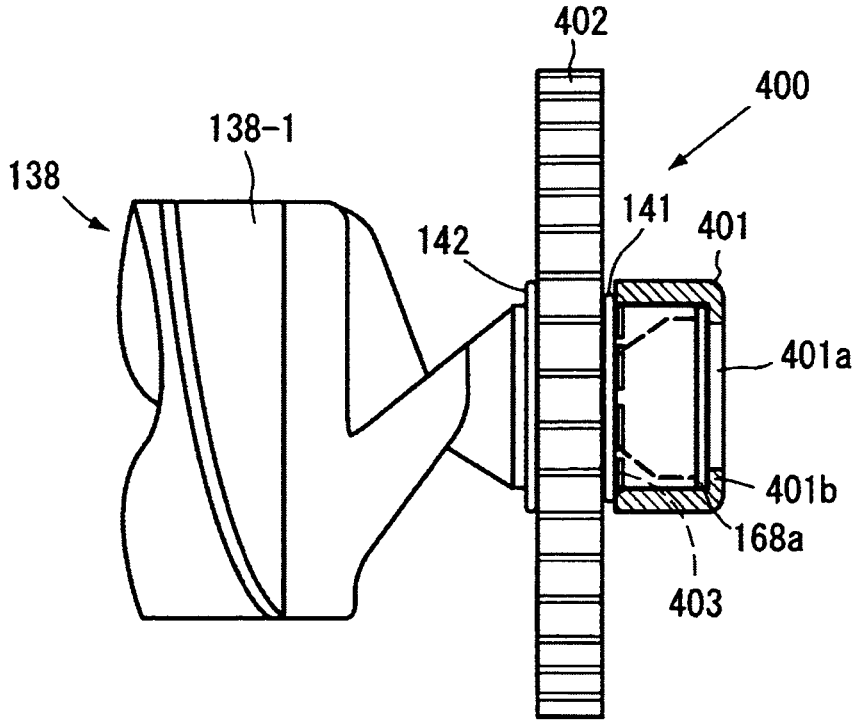
FIG. 41 is a schematic enlarged view illustrating a state where the cap illustrated in FIG. 39 is attached to the powder container.

To attach the cap 400 configured as discussed above to the toner container 138 including the bayonet base 138*a*, the cap 400 is pushed onto the bayonet base 138*a* from the side facing the end surface of the bayonet base 138*a* in a state where the inner cap 168 is inserted into the discharge port 138*b*. When the claws 405 climb over the annular protrusion 141 during progress of the attaching operation, the claws 405 are elastically deformed in a direction of being folded inward. When the claws 405 have climbed over the annular protrusion 141, the gear 402 is positioned between the annular protrusion 141 and the collar 142. Simultaneously, when the claws 405 have climbed over the annular protrusion 141, the elastic deformation is reversed, causing the claws 405 to rise toward the center of the bayonet base 138*a* and engage with the annular protrusion 141. Accordingly, movement of the gear 402 in the axial direction, or, put another way, in the releasing direction M, is restricted by the annular protrusion 141 and the collar 142. Hence, the gear 402 in a slip-off-prevented state is attached to the bayonet base 138*a* as illustrated in FIG. 41. This state where the cap 400 is attached to the toner container 138 is referred to a pre-shipment state where the discharge port 138*b* is in the sealed state.

Figure 42A:
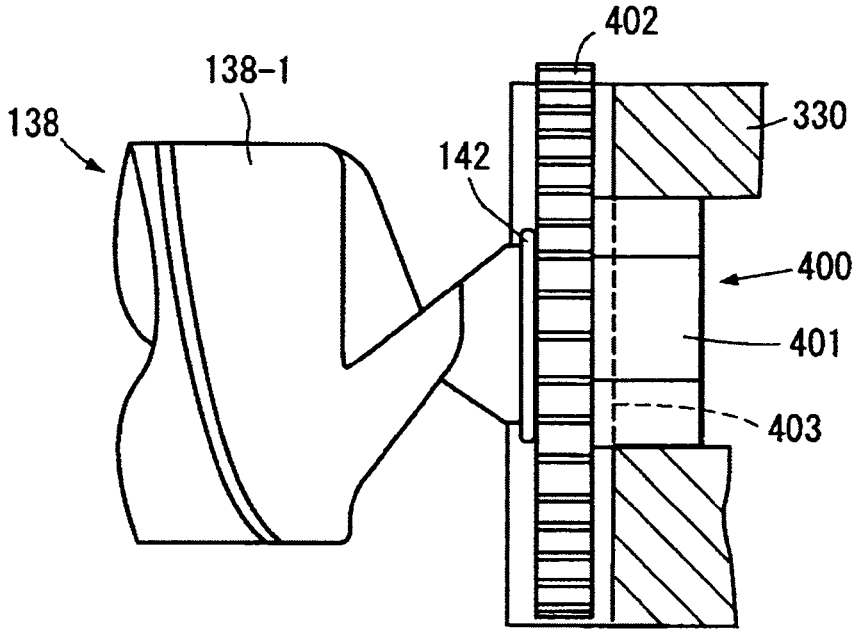
FIG. 42A is a schematic enlarged view illustrating a state where a cover member is mounted on the powder container, to which the cap illustrated in FIG. 39 is attached.

To load the toner container 138 in the sealed state on the apparatus, as illustrated in FIG. 42A, an operator inserts into the cover member 330 the cap 400 attached to the toner container 138. When shape of the fixing member 401 and internal shape of the cover member 330 have fitted, the toner container 138 and the cover member 330 are placed in a one-piece state. Thus, the cap 400 can be attached to the toner container 138 easily, assembly work of the cap 400 is facilitated and operability is also improved. At this time, the gear 402 and the fixing member 401 are assembled into one piece with the releasing unit 403. Accordingly, a force for rotating the toner container 138 and the cover member 330 together is applied to the toner container 138 and the cover member 330. Hence, an operator can determine that the toner container 138 is in the sealed state by checking that the toner container 138 and the cover member 330 do not rotate.

Figure 42B:
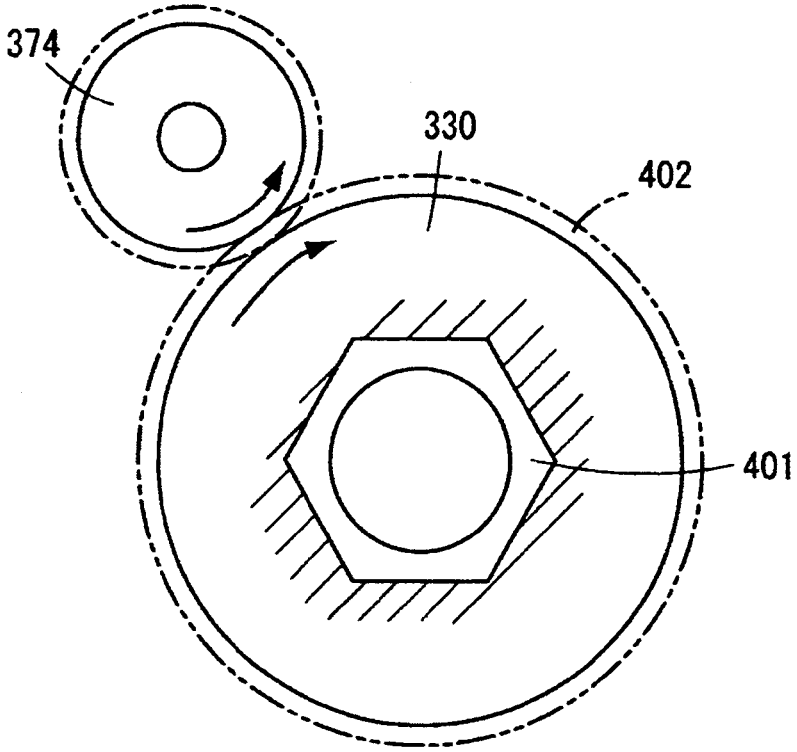
FIG. 42B is a schematic enlarged view illustrating a drive transmission member and a driving gear in mesh with each other.

After the toner container 138 and the cover member 330 assembled into one piece are loaded on the apparatus, the driving gear 374 and the gear 402 are caused to mesh with each other as illustrated in FIG. 42B. When a rotary drive force, being a cap opening force, is transmitted from the driving gear 374 to the gear 402, the force for rotating the entire cap 400 is applied to the cap 400. However, only the gear 402 side is allowed to rotate because the fixing member 401 is fixed to the inside of the cover member 303 and prevented from moving in the rotary direction. Accordingly, the gear 402 and the fixing member 401 are separated from each other at the releasing unit 403. More specifically, in a state where the cap 400 including the fixing member 401 and the gear 402 that are detachably assembled into one piece is attached to the toner container 138, when the rotary drive force is transmitted to the gear 402, the releasing unit 403 is broken, causing the fixing member 401 and the gear 402 to separate from each other. This allows an operator to determine whether the toner container 138 is a not-yet-opened toner container or an already-opened toner container by checking the state of the fixing member 401, or, more specifically, by determining whether the fixing member 401 and the gear 402 rotate in one piece.

Figure 43:
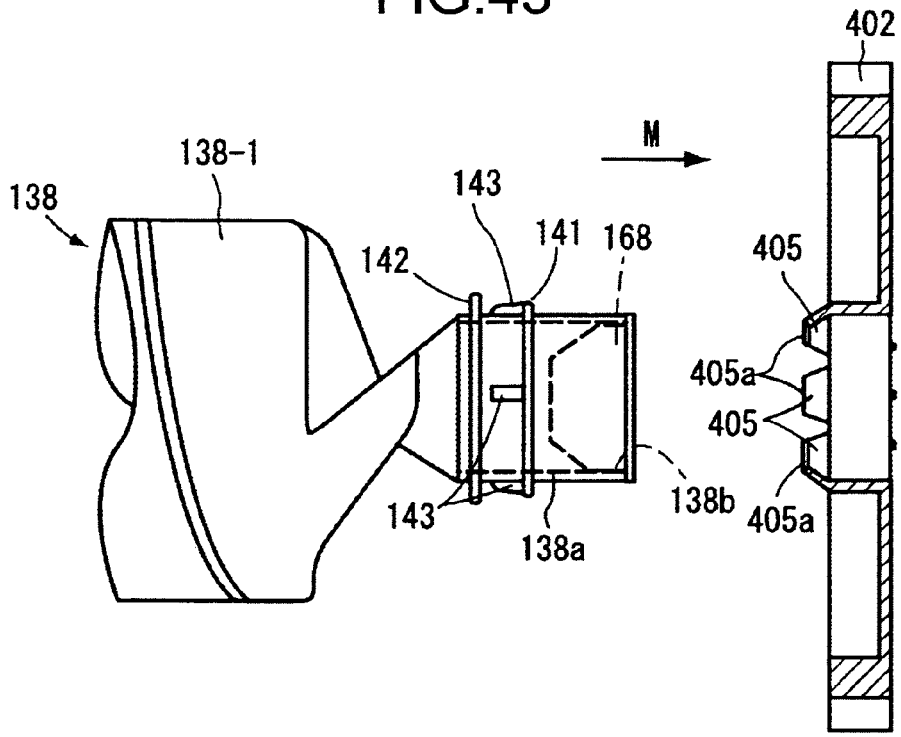
FIG. 43 is a schematic enlarged view illustrating the powder container, from which the drive transmission member having been fixed thereto is removed.

To remove the gear 402 from the toner container 138, being a used one, the gear 402 is pulled toward the annular protrusion 141, or, in other words, in the releasing direction M as illustrated in FIG. 43. This causes leading ends 405*a* of the claws 405 to be caught by the inner side surface of the annular protrusion 141. When a load equal to or exceeding a predetermined value is applied onto the gear 402 in the releasing direction M, the claws 405 having been bent are bent back while pivoting about contact portions between the leading ends and the annular protrusion 141, causing the claws 405 to rise and climb over the annular protrusion 141 in the releasing direction M. Hence, the gear 402 is removed from the toner container 138. This separation between the fixing member 401 and the gear 402 allows determination as to whether the toner container 138 is a new one or an old one to be made at relatively low cost, easily, and with favorable operability.

After removal of the gear 402, the cap 400, being a brand-new one, can be attached to the toner container 138. Hence, each of the toner container 138 and the gear 402 can be made from a material appropriate for its functional property. This negates a manufacture-related limitation, thereby enhancing product durability and achieving cost reduction. Furthermore, the gear 402 can be removed from the toner container 138, being a used one. This increases efficiency in cleaning of the toner container 138, thereby increasing a reuse ratio.

Meanwhile, each of the gear 402 and the gear 302 is a portion, through which rotary force from the driving gear 374 is transmitted to the toner container 138. Accordingly, each of the gear 402 and the gear 302 may be made of a material with a high friction coefficient, or contain a magnet or the like. As the configuration of the drive transmission member other than the gear 402, the plurality of protrusions 308A and 308B and the gears 309 having discussed above with reference to FIGS. 37A to 38B can be formed for use as the drive transmission member by transmitting rotary force thereto. Alternatively, a pin, a gear, or the like that axially protrudes from a disk portion 307 can be formed for use as the drive transmission member.

Figure 44A:
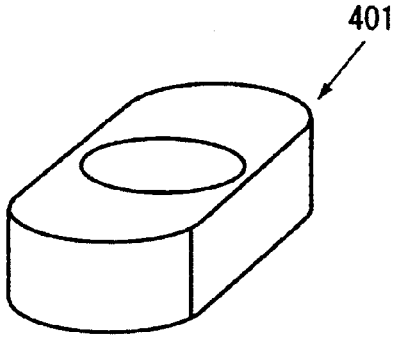
FIGS. 44A to 44E are schematic diagrams illustrating modifications of the fixing member.
Figure 44B:
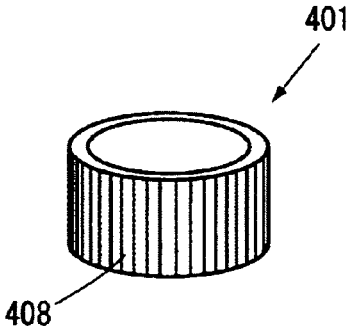
Figure 44C:
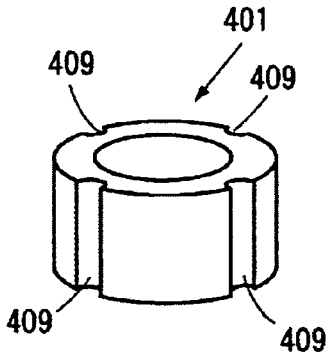

In the present embodiment, the fixing member 401 has a hexagonal outer shape so as not to rotate when the fixing member 401 is arranged in the cover member 330; a recess, whose shape conforms to the fixing member 401 to trap the fixing member 401 therein, is also defined in a portion of the internal shape of the cover member 330 so that the fixing member 401 serves as the rotation stopper. However, the shapes of the fixing member 401 and the recess are not limited thereto. FIGS. 44A to 44E illustrate modifications of the fixing member 401. FIG. 44A illustrates a modification where the fixing member 401 is oval in outer shape. FIG. 44B illustrates a modification where a cylindrical outer peripheral surface of the fixing member 401 has an uneven portion 408, such as a knurled portion, to increase friction coefficient. FIG. 44C illustrates a modification where the plurality of arcuate recesses 409 are defined on the cylindrical outer peripheral surface. As a matter of course, arcuate ribs to be inserted into the recesses 409 are desirably formed on the cover member 330 to fix the fixing member 401 against rotation.

The fixing member 401 and the internal shape of the cover member 330 can be changed according to, for instance, a toner color or a model of an apparatus, on which the toner container 138 is to be mounted. This allows mounting of the toner container 138 of a mistaken toner color or mounting of the toner container 138 on a mistaken apparatus to be prevented. Put another way, the fixing member 401 and the internal shape of the cover member 330 can be used as a unit providing the function of establishing non-interchangeability in terms of color or model.

Figure 44D:
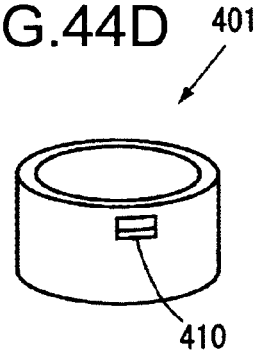
Figure 44E:
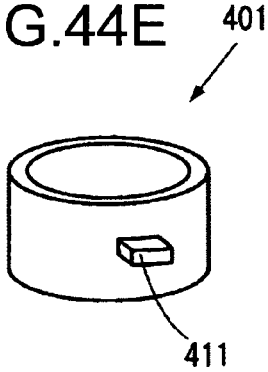

In the modifications illustrated in FIGS. 44A to 44C, the shape of the fixing member 401 has been changed. Alternatively, the function of establishing non-interchangeability in terms of color or model can be performed also by changing the size of the fixing member 401 on a per toner-color basis or on a per apparatus-model basis. FIG. 44D illustrates a modification where a circumferentially-extending groove 410 is defined on the outer peripheral surface of the fixing member 401. FIG. 44E illustrates a modification where a protrusion 411 protruding form the outer peripheral surface of the fixing member 401 is formed. As a matter of course, a protrusion conforming to the groove 410 or a recess conforming to the protrusion 411 is desirably formed on the cover member 330.

Figure 45:
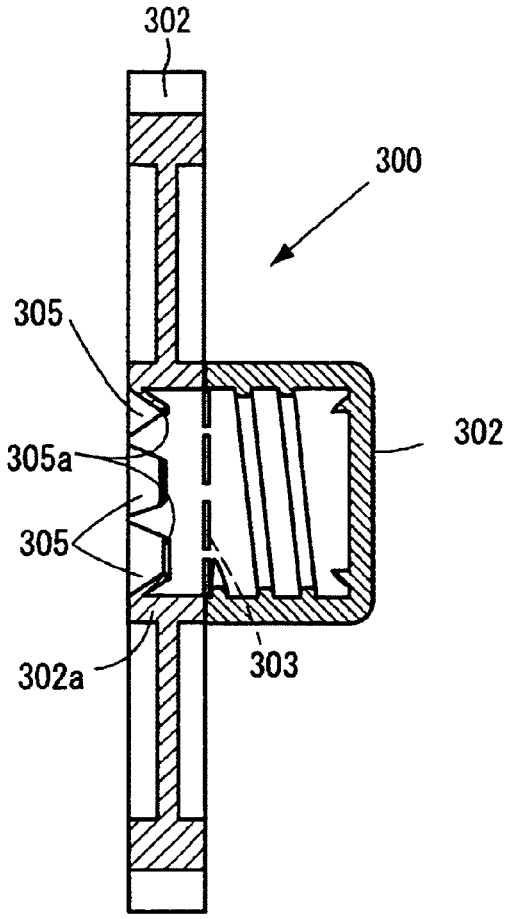
FIG. 45 is a schematic enlarged view illustrating a modification for weight reduction of a gear corresponding to the drive transmission member.

As is common to the caps, thickness of the disk portion of the gear 302 or the gear 402 can be partially reduced as illustrated in FIG. 45 for weight reduction. The portion where the thickness is reduced is not limited to the location illustrated in FIG. 45. The portion is desirably set to a portion that allows smooth release from a molding die.

Figure 46:
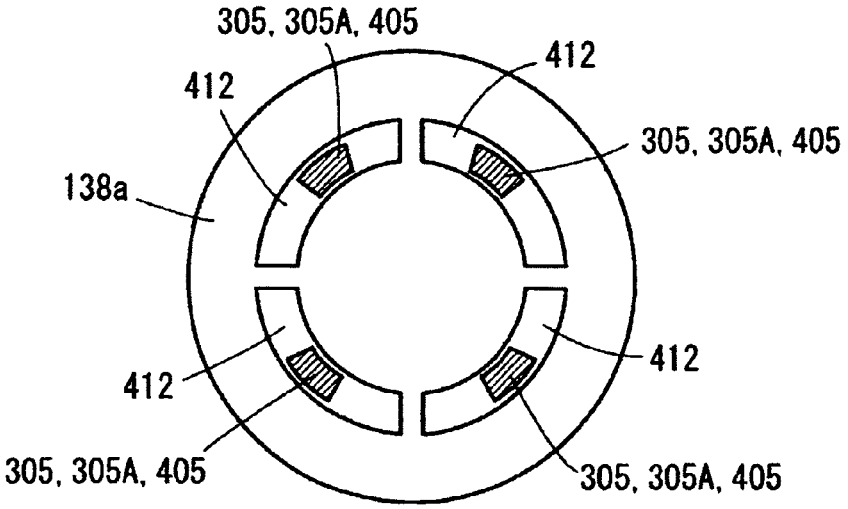
FIG. 46 is a schematic enlarged view illustrating the configuration of claws and grooves corresponding to the drive transmission member.

In the embodiments, the claws 305, 305A, or 405 are formed on the gear 302, 402 so that the claws engage with the protrusions 143 or the protrusions 146 formed on the bayonet base 138*a* of the toner container 138, causing the gear 302, 402 to be rotated together with the toner container 138. Alternatively, as illustrated in FIG. 46, arcuate grooves 412 extending in the circumferential direction can be defined in a circumferential portion of the bayonet base 138*a* so that the claws 305, 305A, 405, or the like are inserted into the arcuate grooves 412, causing the toner container 138 to rotate together with the gear 302, 402.

Figure 47:
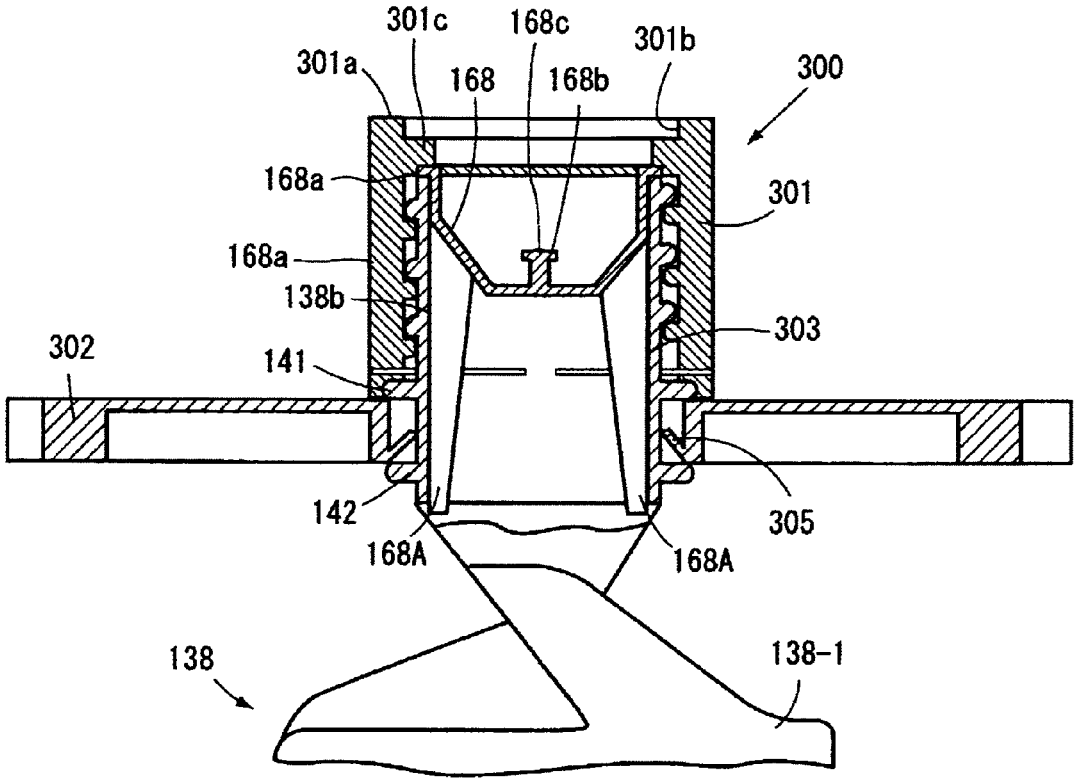
FIG. 47 is a schematic enlarged cross-sectional view illustrating a modification of an inner cap.

As the inner cap 168 discussed in the embodiment, a plurality of vanes 168A longer than the bayonet base 138*a* of the toner container 138 can be formed as illustrated in FIG. 47.

The embodiment discussed above with reference to FIGS. 1 to 24 is summarized in a claim form as follows:

"Claim 1"

A powder container comprising:

a container body that contains powder;

a discharge port, through which the powder in the container body is discharged out of the container body, the discharge port being provided on one end of the container body;

a retainer that holds an information recording device that is rotatable relative to the container body and capable of carrying out communications in any one of a contact manner and a contactless manner; and a positioning member that, when being loaded on an image-forming-apparatus main body, engages with a side where the image-forming-apparatus main body belongs to perform positioning.

"Claim 2"

A powder container comprising:

a container body that contains powder;

a discharge port, through which the powder in the container body is discharged out of the container body, the discharge port being provided on one end of the container body;

a retainer that holds an information recording device that is rotatable relative to the container body and capable of carrying out communications in any one of a contact manner and a contactless manner; and a positioning member that, when being loaded on an image-forming-apparatus main body, performs positioning by using a magnetic member provided on a side where the image-forming-apparatus main body belongs.

"Claim 3"

The powder container of Claim 1 or 2, wherein the positioning member also performs a function of establishing non-interchangeability in terms of any one of color and model.

"Claim 4"

The powder container of Claim 3, wherein the function of establishing non-interchangeability is performed based on variation in shape of the positioning member.

"Claim 5"

The powder container of Claim 3, wherein the function of establishing non-interchangeability is performed based on variation in position of the retainer.

"Claim 6"

The powder container of any one of Claims 1 to 5, wherein when the container body is loaded on the image-forming-apparatus main body, on a cross-section perpendicular to a rotation axis of the container body, if gravity direction is down, the information recording device is located on an outer periphery of the container body on an upper side with respect to a horizontal line passing through the rotation axis.

"Claim 7"

The powder container of any one of Claims 1 to 6, wherein stability of the powder container loaded on the image-forming-apparatus main body is ensured by adjusting weight of the positioning member.

"Claim 8"

The powder container of any one of Claims 2 to 6, wherein the positioning member is a magnetic member and fixes a position of the positioning member when loaded on the image-forming-apparatus main body to a predetermined position by using magnetic force produced by the magnetic member on the side where the image forming apparatus belongs.

"Claim 9"

The powder container of any one of Claims 1 to 8, wherein when the information recording device is a contact information recording device that carries out communications in contact with an information communication unit placed on the side where the image-forming-apparatus main body belongs, positioning of the contact information recording device is performed based on contact resistance between the information recording device and the information communication unit.

"Claim 10"

The powder container of any one of Claims 1 to 8, wherein a movement path of the information recording device moved by rotation of the retainer is positioned inside relative to a movement path of the positioning member.

"Claim 11"

A toner supply device that supplies toner contained in a powder container to a developing device, the toner being in a form of powder, wherein the powder container is the powder container of any one of Claims 1 to 10.

"Claim 12"

An image forming apparatus comprising:

an image carrier, on which a latent image is formed;

a developing unit that supplies developer to a developing area where the latent image is developed; and a toner supply device that supplies toner to the developing device, wherein the toner supply device is the toner supply device of Claim 11.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The invention claimed is:

1. A cap configured to be attached to a developer container that discharges developer contained in a container body out of the container body through a discharge port defined in a portion of the container body, the cap comprising:

a first attaching member; and a second attaching member including a drive transmission member on an outer circumferential surface of the second attaching member, the first attaching member and the second attaching member being detachably assembled into one piece with a releasing part in which a plurality of slits are defined, the releasing part including the plurality of slits for releasing a connection between the first attaching member and the second attaching member.

2. The cap of claim 1, wherein the first attaching member is a main body portion that opens and closes the discharge port, and the second attaching member is detachably integrated with the main body portion and, when the main body portion is removed from the container body to open the discharge port, is separated from the main body portion while remaining on a side of the container body to receive a rotary force.

3. The cap of claim 1, wherein the first attaching member is a fixing member configured to engage with a cover member attached to the container body, and the second attaching member is detachably integrated with the fixing member and, upon receiving a rotary force, is separated from the fixing member while remaining on a side of the container body.

4. The cap of claim 3, wherein the fixing member is shaped to conform to a recess which is defined in a portion of an internal shape of the cover member and whose shape is different depending on a color of the developer contained in the container body or a model of an apparatus on which the developer container is to be mounted.

5. The cap of claim 1, wherein the drive transmission member includes at least one claw that, when the cap is attached to the container body, engages with a portion of the container body to restrict movement of the drive transmission member in a releasing direction and that, when receiving a load greater than a predetermined value in the releasing direction, is deformed to allow the movement of the drive transmission member in the releasing direction.

6. The cap of claim 5, wherein when a driving force is transmitted to the drive transmission member from a driving source, the drive transmission member is restricted in movement in a rotary direction by engagement of the claw with the portion of the container body.

7. The cap of claim 1, wherein:

the slits are at a side of the first attaching member.

8. The cap of claim 1, wherein:

the slits are at a side edge of the first attaching member.

9. A developer container, comprising:

a cover member; and a container body rotatably supported by the cover member, wherein the developer container discharges developer contained in the container body out of the container body through a discharge port defined in a portion of the container body, and further comprises a cap which includes:

a first attaching member; and a second attaching member including a drive transmission member on an outer circumferential surface of the second attaching member, the first attaching member and the second attaching member being detachably assembled into one piece with a releasing part in which a plurality of slits are defined, the releasing part including the plurality of slits for releasing a connection between the first attaching member and the second attaching member.

10. The developer container according to claim 9, wherein:

the first attaching member is a fixing member configured to engage with a cover member attached to the container body, and the second attaching member is detachably integrated with the fixing member and, upon receiving a rotary force, is separated from the fixing member while remaining on a side of the container body.

11. The developer container according to claim 10, wherein:

the fixing member is shaped to conform to a recess which is defined in a portion of an internal shape of the cover member and whose shape is different depending on a color of the developer contained in the container body or a model of an apparatus on which the developer container is to be mounted.

12. The developer container according to claim 9, wherein:

the drive transmission member includes at least one claw that, when the cap is attached to the container body, engages with a portion of the container body to restrict movement of the drive transmission member in a releasing direction and that, when receiving a load greater than a predetermined value in the releasing direction, is deformed to allow the movement of the drive transmission member in the releasing direction.

13. The developer container according to claim 12, wherein:

when a driving force is transmitted to the drive transmission member from a driving source, the drive transmission member is restricted in movement in a rotary direction by engagement of the claw with the portion of the container body.

14. An image forming apparatus comprising:

an image carrier, on which a latent image is formed;

a developing unit that supplies developer to a developing area where the latent image is developed; and a developer supply device that supplies developer to a developing device, wherein the developer supply device comprises a developer container that contains the developer, the developer container discharges the developer contained in a container body out of the container body through a discharge port defined in a portion of the container body and comprises a cap configured to be attached to the developer container, the cap comprises a first attaching member; and a second attaching member including a drive transmission member on an outer circumferential surface of the second attaching member, the first attaching member and the second attaching member being detachably assembled into one piece with a releasing part in which a plurality of slits are defined, the releasing part including the plurality of slits for releasing a connection between the first attaching member and the second attaching member.

15. The image forming apparatus of claim 14, wherein the first attaching member is a main body portion that opens and closes the discharge port, and the second attaching member is detachably integrated with the main body portion and, when the main body portion is removed from the container body to open the discharge port, is separated from the main body portion while remaining on a side of the container body to receive the rotary force.

16. The image forming apparatus of claim 14, wherein the first attaching member is a fixing member configured to engage with a cover member attached to the container body, and the second attaching member is detachably integrated with the fixing member and, upon receiving the rotary force, is separated from the fixing member while remaining on a side of the container body.

17. The image forming apparatus of claim 16, wherein the fixing member is shaped to conform to a recess which is defined in a portion of an internal shape of the cover member and whose shape is different depending on a color of the developer contained in the container body or a model of an apparatus on which the developer container is to be mounted.

18. The image forming apparatus of claim 14, wherein the drive transmission member includes at least one claw that, when the cap is attached to the container body, engages with a portion of the container body to restrict movement of the drive transmission member in a releasing direction and that, when receiving a load greater than a predetermined value in the releasing direction, is deformed to allow the movement of the drive transmission member in the releasing direction.

19. The image forming apparatus of claim 18, wherein when a driving force is transmitted to the drive transmission member from a driving source, the drive transmission member is restricted in movement in a rotary direction by engagement of the claw with the portion of the container body.

20. The image forming apparatus of claim 14, wherein:

the slits are at a side of the first attaching member.

21. The image forming apparatus of claim 14, wherein:

the slits are at a side edge of the first attaching member.

22. A device for use with a developer container that discharges developer contained in a container body, the device comprising:

a cover to seal the developer container and to prevent developer from coming out of the developer container;

slits; and a gear, integrally formed with the cover and the slits, the gear detachable from the cover by twisting the cover, relative to the gear, so that a portion of the cover separates from the gear at a region where the slits are formed.

23. The cap of claim 22, wherein:

the slits are at a side of the cover.

24. The cap of claim 22, wherein:

the slits are at a side edge of the cover.

25. The device of claim 22, wherein the gear includes a rotational stopper to stop a movement in a rotary direction of the gear relative to the container body, and to engage with a protrusion of the container body.

26. A device for use with a developer container that discharges developer contained in a container body, the device comprising:

a cover to seal the developer container and to prevent developer from coming out of the developer container;

a gear; and a breakable joint, integrally formed with the cover and the gear, wherein the cover is detachable from the gear by twisting the cover, relative to the gear, so that the joint is broken and the cover separates from the gear.

27. The device of claim 26, wherein the gear includes a rotational stopper to stop a movement in a rotary direction of the gear relative to the container body, and to engage with a protrusion of the container body.

* * * * *